US010593282B2

(12) United States Patent
Kim

(10) Patent No.: US 10,593,282 B2
(45) Date of Patent: Mar. 17, 2020

(54) DISPLAY DEVICE

(71) Applicant: Samsung Display Co., Ltd., Yongin-si, Gyeonggi-do (KR)

(72) Inventor: Keunwoo Kim, Seongnam-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/224,589

(22) Filed: Dec. 18, 2018

(65) Prior Publication Data

US 2019/0147823 A1 May 16, 2019

Related U.S. Application Data

(63) Continuation of application No. 15/261,779, filed on Sep. 9, 2016, now Pat. No. 10,176,778.

(30) Foreign Application Priority Data

Jan. 4, 2016 (KR) ..... 10-2016-0000549

(51) Int. Cl.
*G09G 3/36* (2006.01)

(52) U.S. Cl.
CPC ..... *G09G 3/3677* (2013.01); *G09G 3/3688* (2013.01); *G09G 3/3696* (2013.01); *G09G 2300/0809* (2013.01); *G09G 2310/0286* (2013.01)

(58) Field of Classification Search
None
See application file for complete search history.

(56) References Cited

U.S. PATENT DOCUMENTS 8,674,979 B2 3/2014 Hayakawa
2008/0218502 A1* 9/2008 Lee ..... G09G 3/3674 345/208
2014/0340380 A1* 11/2014 Song ..... G09G 3/3266 345/212

FOREIGN PATENT DOCUMENTS

KR 10-2007-0101033 A 10/2007
KR 10-2012-0091881 A 8/2012
KR 10-2013-0049617 A 5/2013
KR 10-2014-0025794 A 3/2014
KR 10-1478667 B1 1/2015
KR 10-1585258 B1 1/2016

OTHER PUBLICATIONS

Kim, K. et al., Double-Gate CMOS: Symmetrical-Versus Asymmetrical-Gate Devices, IEEE Transactions on Electron Devices, Feb. 2001, pp. 294-299, vol. 48, No. 2, IEEE.
Sah, W. et al., High-Performance a-Si: H Thin-Film Transistor Using Lightly Doped Channel, IEEE Transactions on Electron Devices, Mar. 1991, pp. 676-678, vol. 38, No. 3, IEEE.

* cited by examiner

*Primary Examiner* — Ifedayo B Iluyomade
(74) *Attorney, Agent, or Firm* — Lewis Roca Rothgerber Christie LLP

(57) ABSTRACT

A k-th driving stage includes a first pull-down transistor. The first pull-down transistor includes a first control electrode receiving a second control signal activated after the k-th gate signal is output, a second control electrode receiving the switching signal synchronized with a clock signal, an input electrode receiving a first discharge voltage, and an output electrode connected to the output electrode of the first output transistor.

20 Claims, 18 Drawing Sheets

DISPLAY DEVICE

CROSS-REFERENCE TO RELATED APPLICATION

This application is a continuation of U.S. patent application Ser. No. 15/261,779, filed Sep. 9, 2016, which claims priority to and the benefit of Korean Patent Application No. 10-2016-0000549, filed Jan. 4, 2016, the entire content of both of which is incorporated herein by reference.

BACKGROUND

1. Field of Disclosure

Aspects of example embodiments of the present disclosure relate to a display device.

2. Description of the Related Art

A display device may include gate lines, data lines, and pixels connected to the gate lines and data lines. The display device may include a gate driving circuit applying gate signals to the gate lines and a data driving circuit applying data signals to the data lines.

The gate driving circuit may include a shift register including a plurality of driving stage circuits (hereinafter, referred to as driving stages). The driving stages may output the gate signals corresponding to the gate lines, respectively. Each of the driving stages may include a plurality of transistors connected to each other.

The above information disclosed in this Background section is provided for enhancement of understanding of the background of the invention, and therefore, it may contain information that does not constitute prior art.

SUMMARY

Aspects of example embodiments of the present disclosure relate to a display device. For example, aspects of some example embodiments of the present disclosure relate to a display device including a gate driving circuit integrated in a display panel.

According to some embodiments of the present disclosure, a display device may include a gate driving circuit having a relatively simplified circuit configuration.

According to some embodiments of the present disclosure, a display device includes: a display panel including a plurality of gate lines; and a gate driving circuit including a plurality of driving stages configured to apply gate signals to the gate lines, a k-th (k is a natural number equal to or greater than 2) driving stage among the driving stages including: a first output transistor including a control electrode connected to a first node, an input electrode configured to receive a clock signal and an output electrode configured to output a k-th gate signal among the gate signals; a capacitor connected between the output electrode of the first output transistor and the control electrode of the first output transistor; a first control transistor configured to output a first control signal to the first node to turn on the first output transistor before the k-th gate signal is output; a first inverter transistor including a first control electrode configured to receive the clock signal, an input electrode configured to receive the clock signal and an output electrode configured to output a switching signal to a second node; and a first pull-down transistor including a first control electrode configured to receive a second control signal activated after the k-th gate signal is output, a second control electrode configured to receive the switching signal, an input electrode configured to receive a first discharge voltage, and an output electrode connected to the output electrode of the first output transistor.

According to some embodiments, the k-th driving stage further includes a second output transistor including a control electrode connected to the first node, an input electrode configured to receive the clock signal and an output electrode configured to output a k-th carry signal synchronized with the k-th gate signal.

According to some embodiments, the k-th driving stage further includes a second pull-down transistor including a first control electrode configured to receive the second control signal, a second control electrode configured to receive the switching signal, an input electrode configured to receive a second discharge voltage having a level different from a level of the first discharge voltage and an output electrode connected to the output electrode of the second output transistor.

According to some embodiments, the k-th driving stage further includes a second control transistor including a first control electrode configured to receive the second control signal, a second control electrode configured to receive the switching signal, and an output electrode connected to the first node.

According to some embodiments, the second control signal is output from a (k+1)th driving stage among the driving stages, and the second control signal is synchronized with the (k+1)th gate signal among the gate signals.

According to some embodiments, the first control transistor includes a first control electrode configured to receive the first control signal, an input electrode configured to receive the first control signal, and an output electrode connected to the first node.

According to some embodiments, the first control signal is output from a (k−1)th driving stage among the driving stages and the first control signal is synchronized with the (k−1)th gate signal among the gate signals.

According to some embodiments, the first control transistor further includes a second control electrode configured to receive a negative bias voltage.

According to some embodiments, the second control electrode of the first control transistor is configured to receive a second discharge voltage.

According to some embodiments, the k-th driving stage further includes a stabilization transistor including a control electrode configured to receive the first control signal, an input electrode configured to receive a second discharge voltage, and an output electrode connected to the second node.

According to some embodiments, the k-th driving stage further includes a third control transistor including a first control electrode configured to receive a third control signal, a second control electrode configured to receive the switching signal, an input electrode configured to receive a second discharge voltage and an output electrode connected to the first node.

According to some embodiments, the third control signal is output from a (k+2)th driving stage among the driving stages and the third control signal is synchronized with the (k+1)th gate signal among the gate signals.

According to some embodiments, the k-th driving stage further includes a second control transistor including a first control electrode configured to receive the second control signal, a second control electrode configured to receive the first discharge voltage, an input electrode configured to receive a second discharge voltage, and an output electrode connected to the first node.

According to some embodiments, the k-th driving stage further includes a second inverter transistor including a first control electrode configured to receive the k-th gate signal, an input electrode configured to receive a second discharge voltage, and an output electrode connected to the second node.

According to some embodiments, at least one transistor of the first inverter transistor and the second inverter transistor further includes a second control electrode configured to receive a negative bias voltage.

According to some embodiments, the second discharge voltage has a level different from a level of the first discharge voltage and the negative bias voltage is the second discharge voltage.

According to some embodiments, the negative bias voltage is the first discharge voltage.

According to some embodiments, the negative bias voltage is a third discharge voltage having a level different from the first and second discharge voltages.

According to some example embodiments, a display device includes: a display panel including a plurality of gate lines; and a gate driving circuit including a plurality of driving stages configured to apply gate signals to the gate lines, a k-th (k is a natural number equal to or greater than 2) driving stage among the driving stages including: a first output transistor including a control electrode connected to a first node, an input electrode receiving a clock signal, and an output electrode outputting a k-th gate signal among the gate signals; a capacitor connected between the output electrode of the first output transistor and the control electrode of the first output transistor; a first control transistor configured to output a first control signal to the first node to turn on the first output transistor before the k-th gate signal is output; a first inverter transistor including a first control electrode configured to receive the clock signal, a second control electrode configured to receive a negative bias voltage, an input electrode configured to receive the clock signal, and an output electrode configured to output a switching signal to a second node; and a first pull-down transistor including a control electrode configured to receive a second control signal activated after the k-th gate signal is output, an input electrode configured to receive a first discharge voltage, and an output electrode connected to the output electrode of the first output transistor.

According to some embodiments, the k-th driving stage further includes a second inverter transistor including a first control electrode configured to receive the k-th gate signal, an input electrode configured to receive a second discharge voltage, and an output electrode connected to the second node According to some embodiments, the second inverter transistor further includes a second control electrode configured to receive the negative bias voltage.

According to some embodiments, the first discharge voltage has a level different from a level of the second discharge voltage and the negative bias voltage is the second discharge voltage.

According to some embodiments, the first discharge voltage has a level different from a level of the second discharge voltage and the negative bias voltage is the first discharge voltage.

According to some embodiments, the negative bias voltage is a third discharge voltage having a level different from the first and second discharge voltages.

According to some embodiments of the present invention, a display device includes: a display panel including a plurality of gate lines; and a gate driving circuit including a plurality of driving stages electrically connected to the gate lines, respectively, a k-th (k is a natural number equal to or greater than 2) driving stage among the driving stages including: an output part configured to output a k-th gate signal and a k-th carry signal in response to a voltage of a first node, the k-th gate signal and the k-th carry signal being generated according to a clock signal; a first control part configured to control the voltage of the first node; a second control part configured to apply a switching signal generated according to the clock signal to a second node; and a pull-down part configured to lower a voltage of the output part after the k-th gate signal and the k-th carry signal are output, wherein the pull-down part includes at least one pull-down transistor including a first control electrode configured to receive a first control signal activated after the k-th gate signal is output, a second control electrode configured to receive the switching signal, an input electrode configured to receive one of first and second discharge voltages having different levels and an output electrode connected to the output part.

According to some embodiments, the pull-down transistor includes: a first pull-down transistor including a first control electrode configured to receive the first control signal, a second control electrode configured to receive the switching signal, an input electrode configured to receive the first discharge voltage, and an output electrode connected to the output part; and a second pull-down transistor including a first control electrode configured to receive the first control signal, a second control electrode configured to receive the switching signal, an input electrode configured to receive the second discharge voltage, and an output electrode connected to the output part.

According to some embodiments, the output part includes: a first output transistor including a control electrode connected to the first node, an input electrode configured to receive the clock signal and an output electrode outputting the k-th gate signal; and a second output transistor including a control electrode connected to the first node, an input electrode configured to receive the clock signal, and an output electrode configured to output the k-th carry signal.

According to some embodiments, the first control part includes: a first control transistor including a first control electrode and an input electrode, which commonly receive a second control signal activated before the k-th gate signal is output and an output electrode connected to the first node; and a second control signal including a first control electrode configured to receive the second control signal, a second control electrode configured to receive the switching signal, an input electrode configured to receive one of the first and second discharge voltages, and an output electrode connected to the first node.

According to some embodiments, the first control transistor further includes a second control electrode configured to receive one of the first and second discharge voltages.

According to some embodiments, the second control part includes: a first inverter transistor including a first control electrode configured to receive the clock signal, an input electrode configured to receive the clock signal, and an output electrode configured to apply a switching signal generated according to the clock signal to the second node; and a second inverter transistor including a first control electrode configured to receive the k-th gate signal, an input electrode configured to receive one of the first and second discharge voltages, and an output electrode connected to the second node.

According to some embodiments, the second inverter transistor further includes a second control electrode configured to receive one of the first and second discharge voltages.

According to some embodiments of the present invention, because the gate driving circuit includes the transistors each having two control electrodes, the number of the transistors may be reduced. The channel characteristic of the transistor including the two control electrodes may be controlled by the second voltage applied to the second control electrode.

According to some embodiments, when the channel characteristic of the transistor including the two control electrodes is controlled, two transistors connected to each other in series may be replaced with one transistor. In addition, according to some embodiments, two transistors interconnected to each other may be replaced with one transistor.

Because the configuration of the gate driving circuit may be relatively simplified, the area for the gate driving circuit may be reduced, and thus the bezel area of the display device may also be relatively reduced.

BRIEF DESCRIPTION OF THE DRAWINGS

The above and other aspects of some embodiments of the present disclosure will become more apparent by reference to the following detailed description when considered in conjunction with the accompanying drawings wherein.

DETAILED DESCRIPTION

Figure 1:
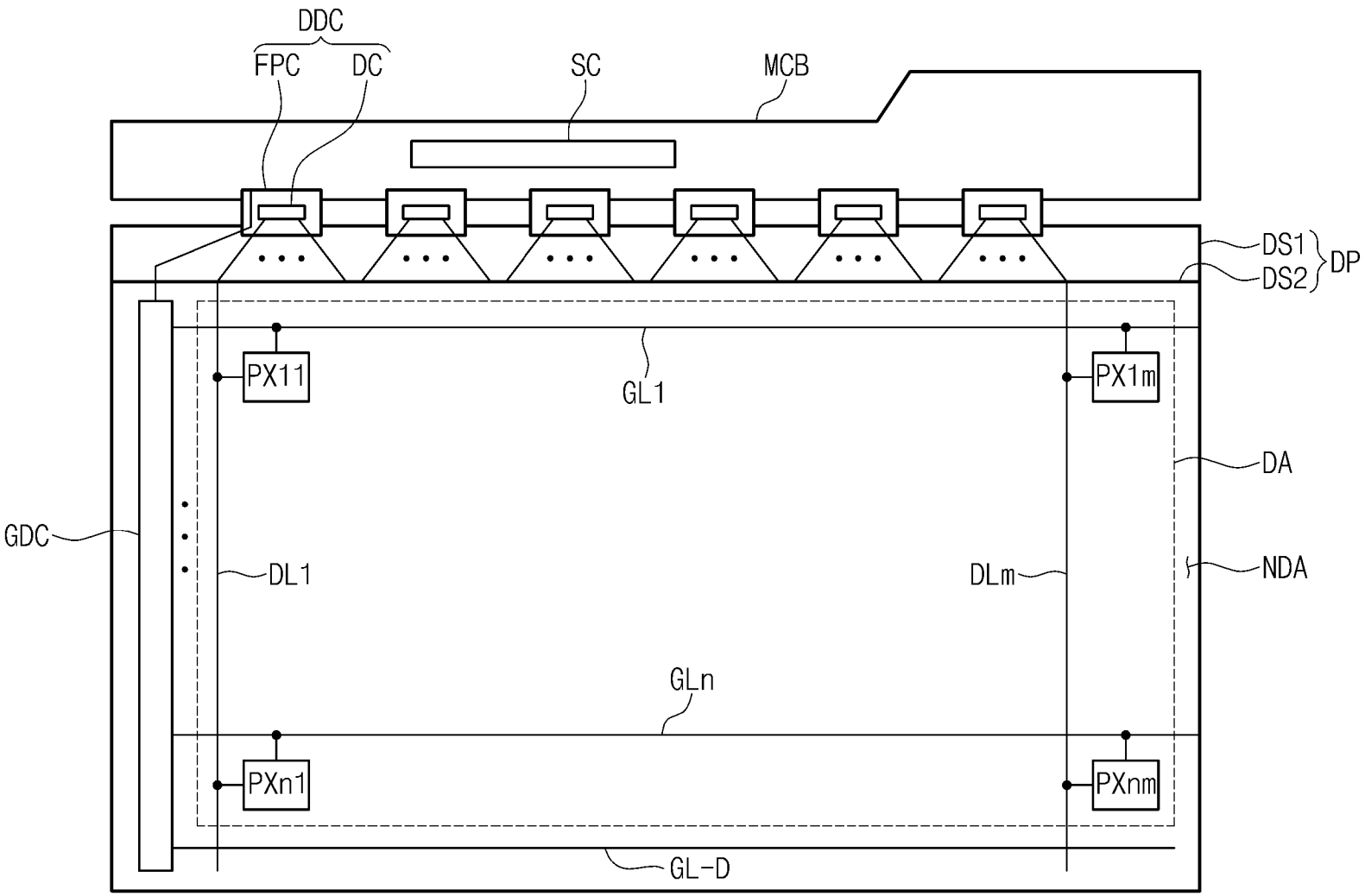
FIG. 1 is a plan view showing a display device according to some example embodiments of the present disclosure.

Hereinafter, aspects of some example embodiments of the present invention will be explained in more detail with reference to the accompanying drawings. In the drawings, layers and regions are exaggerated for clarity. Like numerals refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described.

Figure 2:
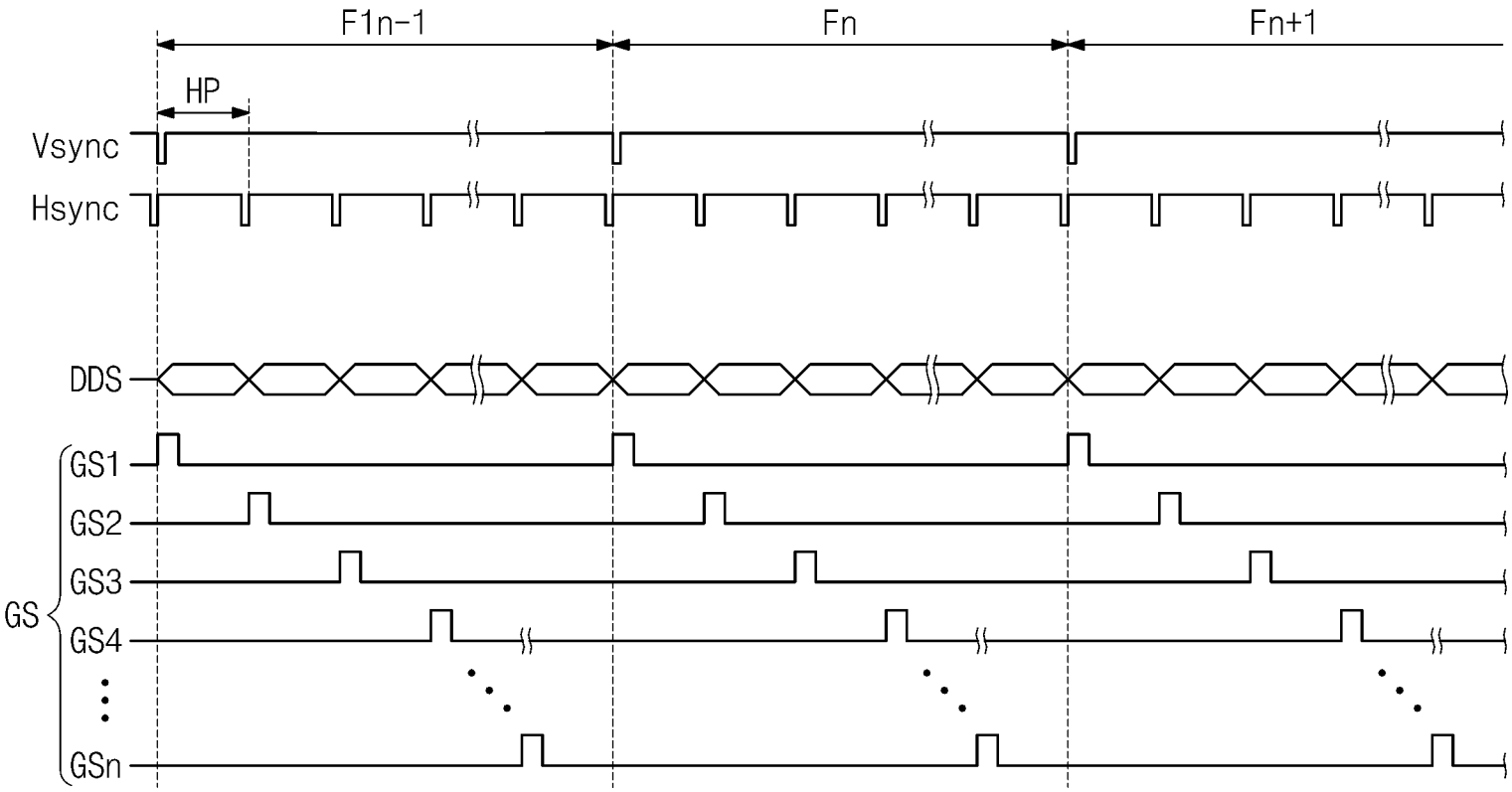
FIG. 2 is a timing diagram showing signals of a display device according to some example embodiments of the present disclosure.

FIG. 1 is a plan view showing a display device according to an example embodiment of the present disclosure, and FIG. 2 is a timing diagram showing signals of a display device according to an example embodiment of the present disclosure.

Referring to FIGS. 1 and 2, the display device according to the present example embodiment includes a display panel DP, a gate driving circuit GDC, and a data driving circuit DDC. FIG. 1 shows one gate driving circuit GDC and six data driving circuits DDC, but the number of the gate and data driving circuits GDC and DDC should not be limited thereto or thereby.

The display panel DP may be, but is not limited to, various display panels, such as a liquid crystal display panel, an organic light emitting display panel, an electrophoretic display panel, an electrowetting display panel, etc. In the present example embodiment, the liquid crystal display panel will be described as the display panel DP. Meanwhile, the liquid crystal display device including the liquid crystal display panel may further include a polarizer and a backlight unit.

The display panel DP includes a first display substrate DS1, a second display substrate DS2 spaced apart from the first display substrate DS1, and a liquid crystal layer LCL (refer to FIG. 4) arranged between the first and second display substrates DS1 and DS2. The display panel DP includes a display area DA in which a plurality of pixels PX11 to PXnm is arranged and a non-display area NDA surrounding (e.g., outside a periphery of) the display area DA when viewed in a plan view.

The first display substrate DS1 includes a plurality of gate lines GL1 to GLn and a plurality of data lines DL1 to DLm crossing the gate lines GL1. The gate lines GL1 to GLn are connected to the gate driving circuit GDC. The data lines DL1 to DLm are connected to the data driving circuit DDC. FIG. 1 shows a portion of the gate lines GL1 to GLn and a portion of the data lines DL1 to DLm. In addition, the first display substrate DS1 further includes a dummy gate line GL-D arranged in the non-display area NDA of the first display substrate DS1.

FIG. 1 shows a portion of the pixels PX11 to PXnm. Each of the pixels PX11 to PXnm is connected to a corresponding gate line of the gate lines GL1 to GLn and a corresponding data line of the data lines DL1 to DLm. However, the dummy gate line GL-D is not connected to the pixels PX11 to PXnm.

The pixels PX11 to PXnm are grouped into a plurality of groups according to colors displayed thereby. Each of the pixels PX11 to PXnm displays one color of light from among the primary colors. The primary colors may include, but are not limited to, a red color, a green color, a blue color, and a white color. The primary colors may further include various colors such as, yellow, cyan, magenta, and the like.

As shown in FIGS. 1 and 2, the gate driving circuit GDC and the data driving circuit DDC receive control signals from a signal controller SC (e.g., a timing controller). The signal controller SC is mounted on a main circuit board MCB. The signal controller SC receives image data and control signals from an external graphic controller. The control signals include a vertical synchronization signal Vsync serving as a signal to distinct frame periods Fn−1, Fn, and Fn+1, a horizontal synchronization signal Hsync serving as a row distinction signal to distinct horizontal periods HP, a data enable signal maintained at a high level during a period, in which data are output, to indicate a data input period, and clock signals.

The gate driving circuit GDC generates gate signals GS1 to GSn in response to the control signal provided from the signal controller SC during the frame periods Fn−1, Fn, and Fn+1 and applies the gate signals GS1 to GSn to the gate lines GL1 to GLn.

The gate signals GS1 to GSn are sequentially output to correspond to the horizontal periods HP. The gate driving circuit GDC may be formed substantially concurrently (e.g., simultaneously) with the pixels PX11 to PXnm through or as part of a thin film process. For instance, the gate driving circuit GDC may be mounted on the non-display area NDA in an amorphous silicon TFT gate driver circuit (ASG) configuration or an oxide semiconductor TFT gate driver circuit (OSG) configuration.

FIG. 1 shows one gate driving circuit GDC connected to left ends of the gate lines GL1 to GLn as a representative example. However, the display device according to the present example embodiment may include two gate driving circuits. One gate driving circuit of the two gate driving circuits is connected to the left ends of the gate lines GL1 to GLn and the other gate driving circuit of the two gate driving circuits is connected to right ends of the gate lines GL1 to GLn. In addition, one gate driving circuit of the two gate driving circuits is connected to odd-numbered gate lines of the gate lines GL1 to GLn and the other gate driving circuit of the two gate driving circuits is connected to even-numbered gate lines of the gate lines GL1 to GLn.

As shown in FIGS. 1 and 2, the data driving circuit DDC generates grayscale voltages corresponding to the image data provided from the signal controller SC in response to the control signal provided from the signal controller SC. The data driving circuit DDC applies the grayscale voltages to the data lines DL1 to DLm as data voltages DDS.

The data voltages DDS include positive (+) data voltages having a positive polarity with respect to a common voltage and/or negative (−) data voltage having a negative polarity with respect to the common voltage. A portion of the data voltages applied to the data lines DL1 to DLm during each horizontal period HP has the positive polarity and the other portion of the data voltages applied to the data lines DL1 to DLm during each horizontal period HP has the negative polarity. The polarity of the data voltages DDS is inverted according to the frame periods Fn−1, Fn, and Fn+1 to prevent liquid crystals from burning and deteriorating. The data driving circuit DDC generates the data voltages inverted in the unit of frame period in response to an inversion signal.

The data driving circuit DDC includes a driving chip DC and a flexible circuit board FPC on which the driving chip DC is mounted. The flexible circuit board FPC electrically connects the main circuit board MCB and the first display substrate DS1. Each of the driving chips DC applies a corresponding data voltage of the data voltages to a corresponding data line of the data lines DL1 to DLm.

In FIG. 1, the data driving circuit DDC is provided in a tape carrier package (TCP) form, but it should not be limited thereto or thereby. That is, the data driving circuit DDC may be mounted on the first display substrate DS1 in a chip-on-glass (COG) form to correspond to the non-display area NDA.

Figure 3:
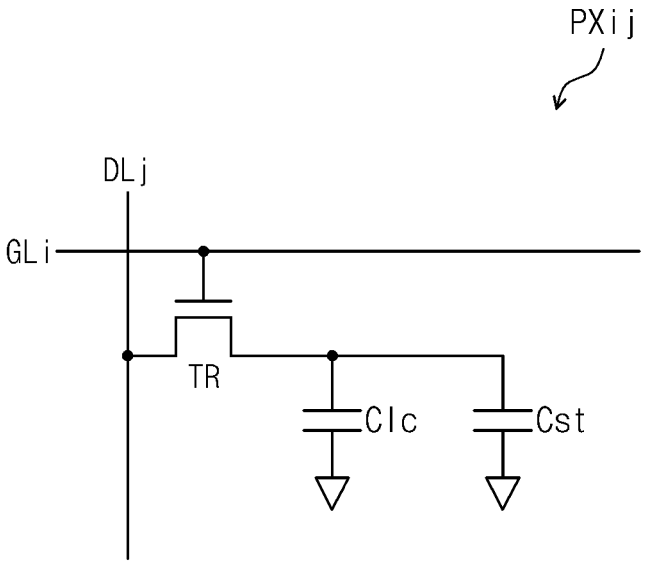
FIG. 3 is an equivalent circuit diagram showing a pixel according to some example embodiments of the present disclosure.
Figure 4:
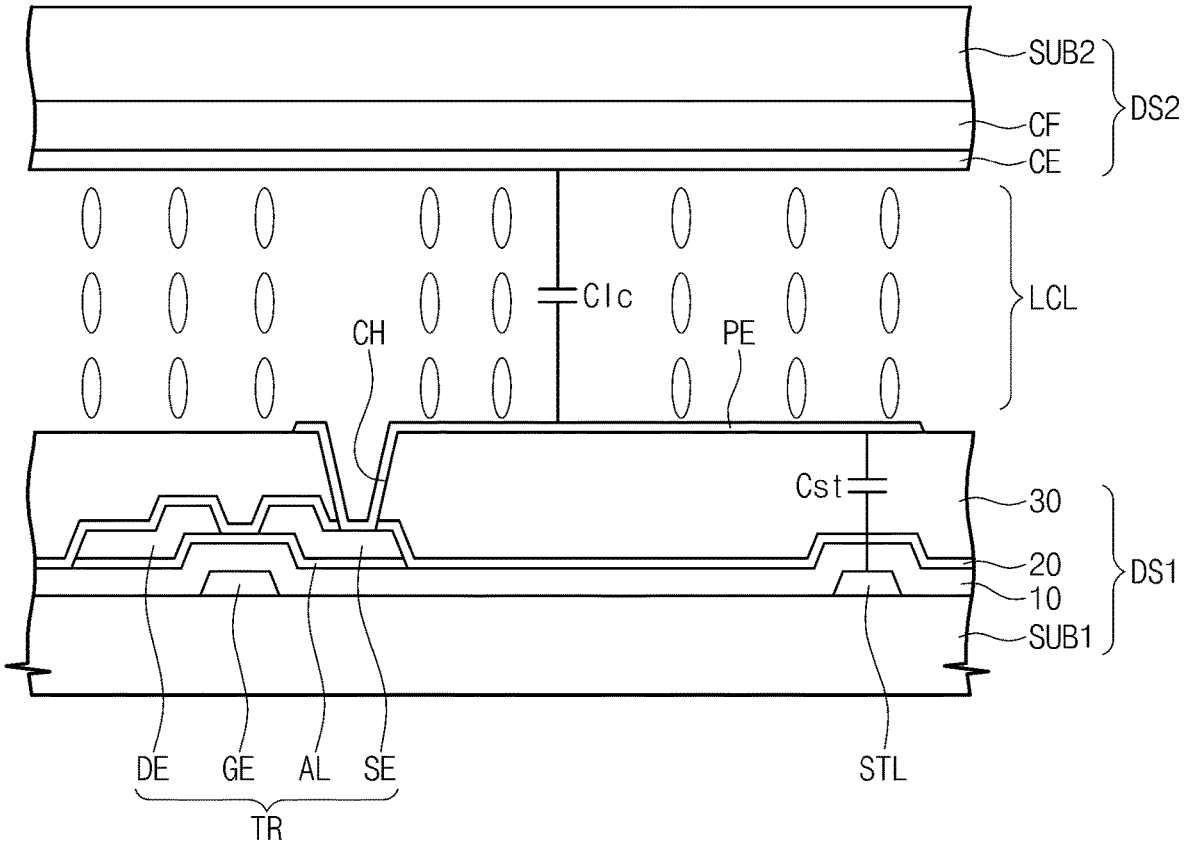
FIG. 4 is a cross-sectional view showing a pixel of a display panel according to some example embodiments of the present disclosure.

FIG. 3 is an equivalent circuit diagram showing a pixel PXij according to an example embodiment of the present disclosure, and FIG. 4 is a cross-sectional view showing a pixel of a display panel according to an example embodiment of the present disclosure. Each of the pixels PX11 to PXnm shown in FIG. 1 may have an equivalent circuit diagram shown in FIG. 3.

Referring to FIG. 3, the pixel PXij includes a pixel thin film transistor TR (hereinafter, referred to as a pixel transistor), a liquid crystal capacitor Clc, and a storage capacitor Cst. Hereinafter, a term of "transistor" used herein means a thin film transistor, and the storage capacitor Cst may be omitted.

The pixel transistor TR is electrically connected to an i-th gate line GLi and a j-th data line DLj. The pixel transistor TR outputs a pixel voltage corresponding to the data signal provided from the j-th data line DLj in response to the gate signal provided from the i-th gate line GLi.

The liquid crystal capacitor Clc is charged with the pixel voltage output from the pixel transistor TR. An alignment of liquid crystal directors included in the liquid crystal layer LCL (refer to FIG. 4) is changed in accordance with an amount of electric charges charged in the liquid crystal capacitor Clc. A light incident to the liquid crystal layer LCL transmits through or is blocked by the alignment of the liquid crystal directors.

The storage capacitor Cst and the liquid crystal capacitor Clc are connected in parallel. The storage capacitor Cst maintains the alignment of the liquid crystal directors for a period of time (e.g., a predetermined period of time).

Referring to FIG. 4, the pixel transistor TR is arranged on a first base substrate SUB1. The pixel transistor TR includes a control electrode GE connected to the i-th gate line GLi (refer to FIG. 3), an active part AL overlapped with the control electrode GE, an input electrode DE connected to the j-th data line DLj (refer to FIG. 3), and an output electrode SE arranged to be spaced apart from the input electrode DE.

The liquid crystal capacitor Clc includes a pixel electrode PE and a common electrode CE. The storage capacitor Cst includes the pixel electrode PE and a portion of a storage line STL overlapped with the pixel electrode PE.

The i-th gate line GLi and the storage line STL are arranged on a surface of the first display substrate DS1. The control electrode GE is branched from the i-th gate line GLi. The i-th gate line GLi and the storage line STL include a metal material, such as aluminum (Al), silver (Ag), copper (Cu), molybdenum (Mo), chromium (Cr), tantalum (Ta), titanium (Ti), or an alloy thereof. Each of the i-th gate line GLi and the storage line STL has a multi-layer structure of a titanium layer and a copper layer.

A first insulating layer 10 is arranged on the first display substrate DS1 to cover the control electrode GE and the storage line STL. The first insulating layer 10 includes at least one of an inorganic material and an organic material. The first insulating layer 10 is an organic or inorganic layer. The first insulating layer 10 has a multi-layer structure of a silicon nitride layer and a silicon oxide layer.

The active part AL is arranged on the first insulating layer 10 to overlap with the control electrode GE. The active part AL includes a semiconductor layer and an ohmic contact layer. The semiconductor layer includes amorphous silicon or polysilicon. The semiconductor layer is arranged on the first insulating layer 10, and the ohmic contact layer is arranged on the semiconductor layer. The ohmic contact layer is highly doped with a dopant than the semiconductor layer SCL.

In the present example embodiment, the active part AL includes a metal oxide semiconductor layer. The metal oxide semiconductor layer includes indium tin oxide (ITO), indium gallium zinc oxide (IGZO), zinc oxide (ZnO), etc. The materials may be amorphous.

The output electrode SE and the input electrode DE are arranged on the active part AL. The output electrode SE and the input electrode DE are spaced apart from each other. Each of the output electrode SE and the input electrode DE is partially overlapped with the control electrode GE.

A second insulating layer 20 is arranged on the first insulating layer 10 to cover the active part AL, the output electrode SE, and the input electrode DE. The second insulating layer 20 includes an inorganic or organic material. The second insulating layer 20 is an organic or inorganic layer. The second insulating layer 20 has a multi-layer structure of a silicon nitride layer and a silicon oxide layer.

FIG. 1 shows the pixel transistor TR having a staggered structure, but the structure of the pixel transistor TR should not be limited to the staggered structure. That is, the pixel transistor TR may have a planar structure.

A third insulating layer 30 is arranged on the second insulating layer 20. The third insulating layer 30 provides an evenness surface. The third insulating layer 30 includes an organic material.

The pixel electrode PE is arranged on the third insulating layer 30. The pixel electrode PE is connected to the output electrode SE through a contact hole CH formed through the second and third insulating layers 20 and 30. An alignment layer is arranged on the third insulating layer 20 to cover the pixel electrode PE.

The second display substrate DS2 includes a second base substrate SUB2 and a color filter layer CF arranged on a surface of the second base substrate SUB2. The common electrode CE is arranged on the color filter layer CF. The common electrode CE is applied with a common voltage. The common voltage has a level different from that of the pixel voltage. An alignment layer may be arranged on the common electrode CE to cover the common electrode CE. Another insulating layer may be arranged between the color filter layer CF and the common electrode CE.

The pixel electrode PE and the common electrode CE, which face each other such that the liquid crystal layer LCL is arranged between the pixel electrode PE and the common electrode CE, form the liquid crystal capacitor Clc. In addition, the pixel electrode PE and the portion of the storage line STL, which face each other such that the first, second, and third insulating layers 10, 20, and 30 are arranged between the pixel electrode PE and the portion of the storage line STL, form the storage capacitor Cst. The storage line STL is applied with a storage voltage having a level different from that of the pixel voltage. The storage voltage may have the same level as or different level from that of the common voltage.

Meanwhile, different from the circuit diagram of the pixel PXij shown in FIG. 3, at least one of the color filter layer CF and the common electrode CE may be arranged on the first display substrate DS1. In other words, the liquid crystal display panel according to the present example embodiment may include a vertical alignment (VA) mode pixel, a patterned vertical alignment (PVA) mode pixel, an in-plane switching (IPS) mode pixel, a fringe-field switching (FFS) mode pixel, or a plane-to-line switching (PLS) mode pixel.

Figure 5:
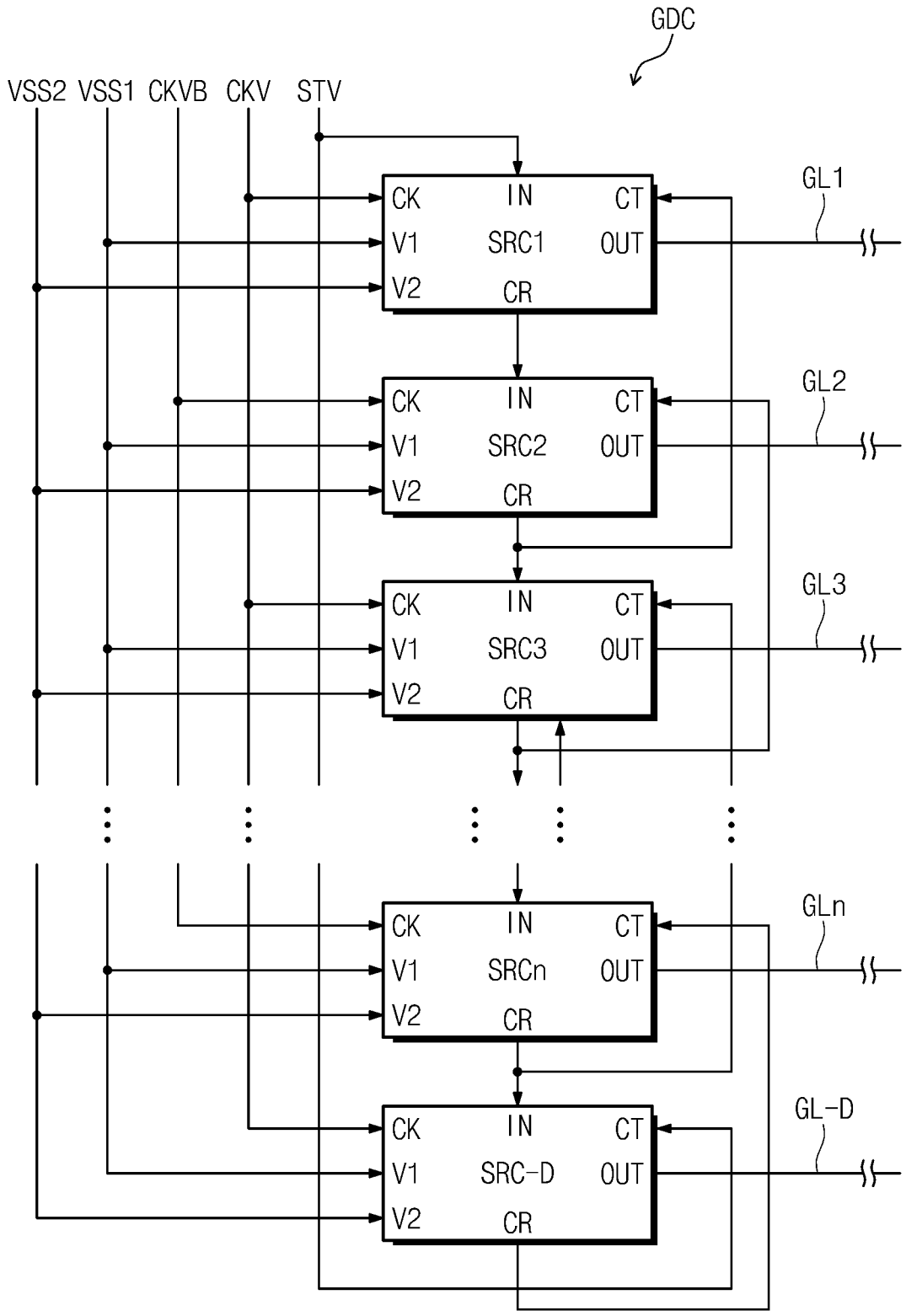
FIG. 5 is a block diagram showing a gate driving circuit according to some example embodiments of the present disclosure.

FIG. 5 is a block diagram showing a gate driving circuit GDC according to an example embodiment of the present disclosure. Referring to FIG. 5, the gate driving circuit GDC includes a plurality of driving stages SRC1 to SRCn connected to each other one after another.

In the present example embodiment, the driving stages SRC1 to SRCn are connected to the gate lines GL1 to GLn, respectively. The driving stages SRC1 to SRCn apply the gate signals to the gate lines GL1 to GLn, respectively. The gate driving circuit GDC may further include a dummy stage SRC-D connected to a last driving stage SRCn among the driving stages SRC1 to SRCn. The dummy stage SRC-D is connected to a dummy gate line GL-D.

Each of the driving stages SRC1 to SRCn includes an output terminal OUT, a carry terminal CR, an input terminal IN, a control terminal CT, a clock terminal CK, a first voltage input terminal V1, and a second voltage input terminal V2.

The output terminal OUT of each of the driving stages SRC1 to SRCn is connected to a corresponding gate line of the gate lines GL1 to GLn. The gate signals GS1 to GSn generated by the driving stages SRC1 to SRCn are applied to the gate lines GL1 to GLn through the output terminals OUT.

The carry terminal CR of each of the driving stages SRC1 to SRCn is electrically connected to the input terminal IN of a next driving stage following the corresponding driving stage. The carry terminals CR of the driving stages SRC1 to SRCn output carry signals, respectively.

The input terminal IN of each of the driving stages SRC1 to SRCn receives the carry signal from a previous driving stage prior to the corresponding driving stage. For instance, the input terminal IN of a third driving stage SRC3 receives the carry signal output from a second driving stage SRC2. Among the driving stages SRC1 to SRCn, the input terminal IN of the first driving stage SRC1 receives a start signal STV that starts an operation of the gate driving circuit 100 instead of the carry signal of the previous driving stage.

The control terminal CT of each of the driving stages SRC1 to SRCn is electrically connected to the carry terminal CR of the next driving stage following the corresponding driving stage. The control terminal CT of each of the driving stages SRC1 to SRCn receives the carry signal of the next driving stage following the corresponding driving stage. For instance, the control terminal CT of the second driving stage SRC2 receives the carry signal output from the carry terminal CR of the third driving stage SRC3. In the present example embodiment, the control terminal CT of each of the driving stages SRC1 to SRCn may be electrically connected to the output terminal OUT of the next driving stage following the corresponding driving stage.

The control terminal CT of the driving stage SRCn receives the carry signal output from the carry terminal CR of the dummy stage SRC-D. The control terminal CT of the dummy stage SRC-D receives the start signal STV.

The clock terminal CK of each of the driving stages SRC1 to SRCn receives a first clock signal CKV or a second clock signal CKVB. The clock terminals CK of the odd-numbered driving stages SRC1 and SRC3 among the driving stages SRC1 to SRCn receive the first clock signal CKV. The clock terminals CK of the even-numbered driving stages SRC2 and SRCn among the driving stages SRC1 to SRCn receive the second clock signal CKVB. The first and second clock signals CKV and CKVB have different phases from each other. The second clock signal CKVB is obtained by inverting or delaying the phase of the first clock signal CKV.

The first voltage input terminal V1 of each of the driving stages SRC1 to SRCn receives a first discharge voltage VSS1, and the second voltage input terminal V2 of each of the driving stages SRC1 to SRCn receives a second discharge voltage VSS2. In the present example embodiment, the second discharge voltage VSS2 has a voltage level lower than that of the first discharge voltage VSS1. For example, the second discharge voltage VSS2 is about −11.5 volts, and the first discharge voltage VSS1 is about −7.5 volts.

In each of the driving stages SRC1 to SRCn according to the present example embodiment, one of the output terminal OUT, the input terminal IN, the carry terminal CR, the control terminal CT, the clock terminal CK, the first voltage input terminal V1, and the second voltage input terminal V2 is omitted or another terminal is added to each of the driving stages SRC1 to SRCn. For instance, one of the first and second voltage input terminals V1 and V2 may be omitted. In addition, a connection relation between the driving stages SRC1 to SRCn may be changed.

Figure 6:
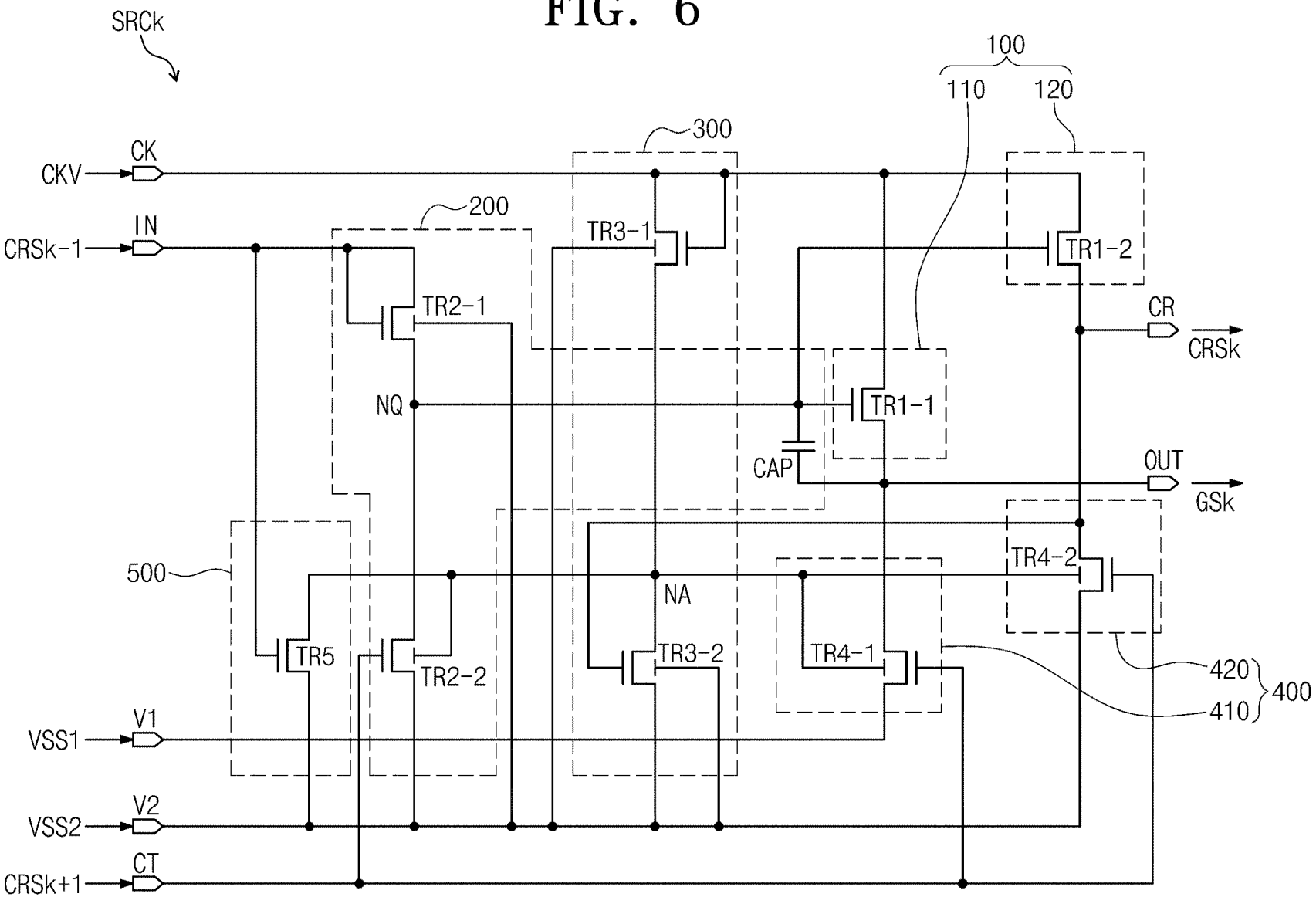
FIG. 6 is a circuit diagram showing a driving stage according to some example embodiments of the present disclosure.
Figure 7:
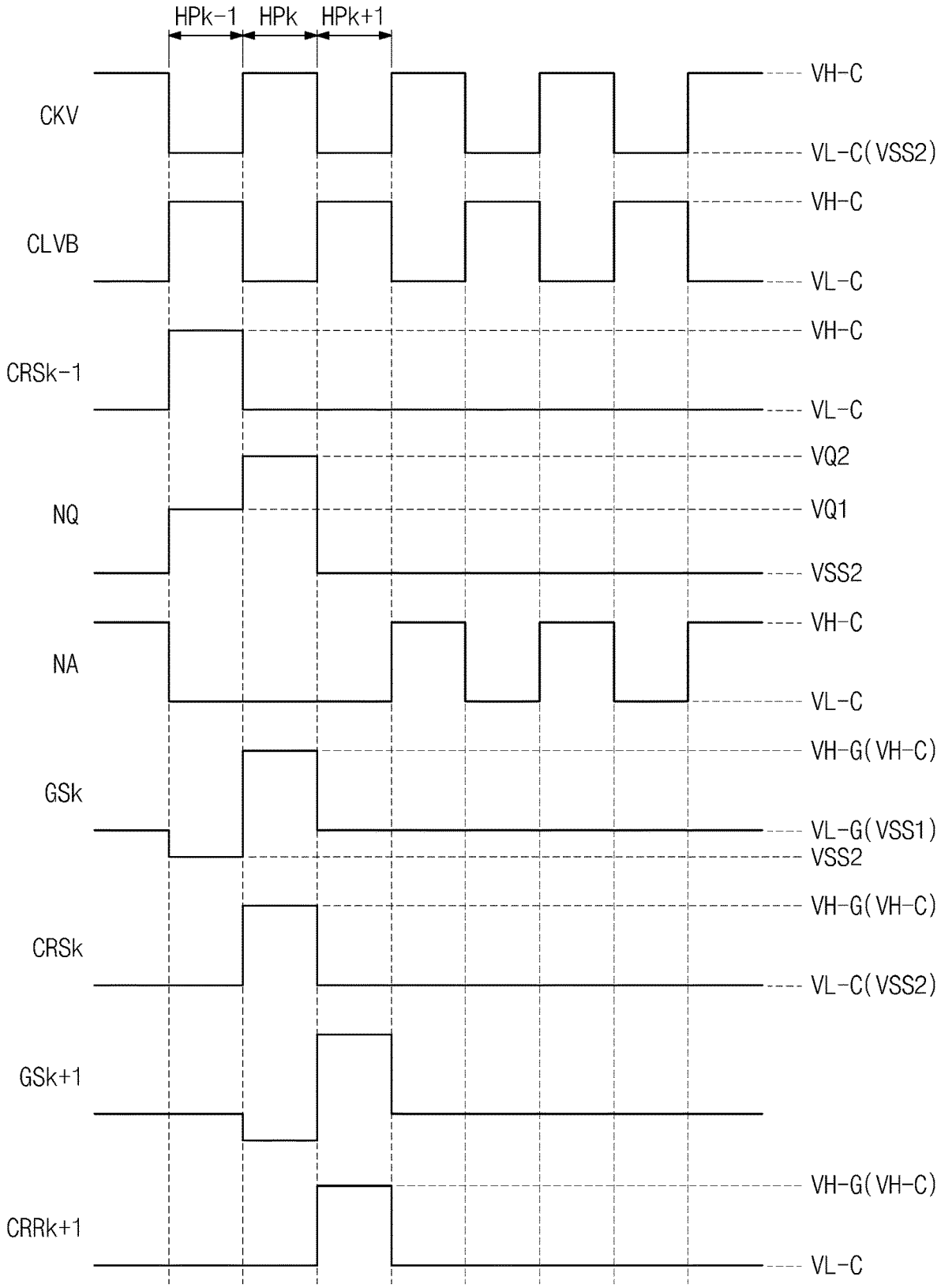
FIG. 7 is a waveform diagram showing a signal of the driving stage shown in FIG. 6.

FIG. 6 is a circuit diagram showing a driving stage SRCk according to an example embodiment of the present disclosure, and FIG. 7 is a waveform diagram showing a signal of the driving stage SRCk shown in FIG. 6. For the convenience of explanation, FIG. 7 shows input and output signals as a square wave, but the input and output signals may be deformed due to external factors, such as RC delay.

FIG. 6 shows a k-th driving stage SRCk among the n driving stages SRC1 to SRCn shown in FIG. 5 as a representative example. Each of the driving stages SRC1 to SRCn shown in FIG. 5 may have substantially the same circuit diagram as that of the k-th driving stage SRCk.

Referring to FIGS. 6 and 7, the k-th driving stage SRCk includes an output part 100, a first control part 200, a second control part 300, a pull-down part 400, and a stabilization part 500. The circuit diagram of the k-th driving stage SRCk is not limited to the above-described configuration. Rather, various modifications to the k-th driving stage SRCk may be made without departing from the spirit and scope of the present invention. For instance, according to some embodiments, the stabilization part 500 may be omitted.

The output part 100 outputs a k-th gate signal GSk and a k-th carry signal CRSk, which are generated on the basis of the clock signal CKV, in response to a voltage of a first node NQ. The first control part 200 controls the voltage of the first node NQ of the output part 100. The output part 100 is turned on or off in accordance with the voltage level of the first node NQ. The second control part 300 outputs a switching signal generated on the basis of the clock signal CKV to a second node NA. The pull-down part 400 pulls down the voltage of the output part 100 after the k-th gate signal GSk and the k-th carry signal CRSk are output. The stabilization part 500 applies a low voltage to the second node NA before the k-th gate signal GSk is output.

Referring to FIGS. 6 and 7, the output part 100 includes a first output part 110 that outputs the k-th gate signal GSk and a second output part 120 that outputs the k-th carry signal CRSk. The k-th carry signal CRSk is a signal synchronized with the k-th gate signal GSk. In the present example embodiment, the expression "a signal is synchronized with a signal" means that two signals have a high voltage during the same period. The levels of the high voltages of the two signals, however, are not necessarily equal to each other.

The first output part 110 includes a first output transistor TR1-1. The first output transistor TR1-1 includes a control electrode connected to the first node NQ, an input electrode receiving the first clock signal CKV, and an output electrode outputting the k-th gate signal GSk. The second output part 120 includes a second output transistor TR1-2. The second output transistor TR1-2 includes a control electrode connected to the first node NQ, an input electrode receiving the first clock signal CKV, and an output electrode outputting the k-th carry signal GRSk.

As shown in FIG. 7, the first clock signal CKV and the second clock signal CKVB have opposite phases to each other. The first clock signal CKV and the second clock signal CKVB have a phase difference of about 180 degrees. Each of the first and second clock signals CKV and CKVB includes low periods VL-C having relatively low level (low voltage) and high periods VH-C having relatively high level (high voltage). Each of the first and second clock signals CKV and CKVB includes the low periods alternately arranged with the high periods. The high voltage VH-C may be about 30 volts, and the low voltage VL-C may be about −11.5 volts. The low voltage VL-C may have substantially the same level as the second discharge voltage VSS2.

The k-th gate signal GSk includes a low period VL-G having the relatively low level (low voltage) and a high period VH-G having the relatively high level (high level). The low voltage VL-G of the k-th gate signal GSk has substantially the same level as the first discharge voltage VSS1. The low voltage VL-G is about −7.5 volts. The k-th gate signal GSk has substantially the same level as the low voltage VL-C of the first clock signal CKV during periods HPk−1 (refer to FIG. 7). The high voltage VH-G of the k-th gate signal GSk has substantially the same level as the high voltage VH-C of the first clock signal CKV.

The k-th carry signal CRSk includes a low period VL-C having relatively low level (low voltage) and high periods VH-C having relatively high level (high voltage). Because the k-th carry signal CRSk is generated on the basis of the first clock signal CKV, the k-th carry signal CRSk has a similar voltage level to the first clock signal CKV.

Referring to FIGS. 6 and 7, the first control part 200 controls an operation of the first and second output parts 110 and 120. The first control part 200 turns on the first and second output parts 110 and 120 in response to a (k−1)th carry signal CRSk−1 output from a (k−1)th driving stage SRCk−1. The first control part 200 turns off the first and second output parts 110 and 120 in response to a (k+1)th carry signal CRSk+1 output from a (k+1)th driving stage. In addition, the first control part 200 maintains the turn-off state of the first and second output parts 110 and 120 in response to a switching signal output from the second control part 300.

The first control part 200 includes a first control transistor TR2-1, a second control transistor TR2-2, and a capacitor CAP, but embodiments of the present invention are not limited thereto or thereby. For example, according to some embodiments, the second control transistor TR2-2 may be omitted from the first control part 200, or one or more additional control transistors may be added to the first control part 200.

The first control transistor TR2-1 applies a first control signal to the first node NQ to control an electric potential of the first node NQ before the k-th gate signal GSk is output. FIG. 7 shows a horizontal period HPk (hereinafter, referred to as a k-th horizontal period) during in which the k-th gate signal GSk is output, a previous horizontal period HPk−1 (hereinafter, referred to as a (k−1)th horizontal period), and a next horizontal period HPk+1 (hereinafter, referred to as a (k+1)th horizontal period).

The first control transistor TR2-1 includes a first control electrode and an input electrode, which commonly receive the (k−1)th carry signal CRSk−1. The first control transistor TR2-1 includes an output electrode connected to the first node NQ. In the present example embodiment, the first control signal may be the (k−1)th carry signal CRSk−1. In the present example embodiment, the first control transistor TR2-1 may include two control electrodes. The first control transistor TR2-1 further includes a second control electrode receiving the second discharge voltage VSS2. The second control electrode receives a negative bias voltage (or a negative direct current voltage), and the voltage level thereof may be changed. This will be described in more detail below.

The second control transistor TR2-2 is connected between the voltage input terminal V2 and the first node NQ. The second control transistor TR2-2 includes a first control electrode applied with the second control signal, an input electrode applied with the second discharge voltage VSS2, and an output electrode connected to the first node NQ. In the present example embodiment, the second control signal may be the (k+1)th carry signal CRSk+1. In the present example embodiment, the second control signal is synchronized with the (k+1)th gate signal CRSk+1, and the second control signal may be the (k+1)th gate signal GSk+1. In the present example embodiment, the second control transistor TR2-2 may include two control electrodes. The second control transistor TR2-2 further includes a second control electrode receiving the switching signal.

The second control transistor TR2-2 applies the second discharge voltage VSS2 to the first node NQ in response to the second control signal. The second control transistor TR2-2 applies the second discharge voltage VSS2 to the first node NQ in response to the switching signal. The second control signal and the switching signal are activated in different periods from each other to have the high period.

The capacitor CAP is connected between the output electrode of the first output transistor TR1-1 and the control electrode of the first output transistor TR1-1 (or the first node NQ). The capacitor CAP has a first electrode connected to the output electrode of the first output transistor TR1-1 and a second electrode connected to the control electrode of the first output transistor TR1-1. The capacitor CAP increases the voltage of the first node NQ as described later.

As shown in FIG. 7, the electric potential of the first node NQ increases to a first high voltage VQ1 by the operation of the first control transistor TR2-1 during the (k−1)th horizontal period HPk−1. When the (k−1)th carry signal CRSk−1 is applied to the first node NQ, the capacitor CAP is charged with a voltage corresponding to the (k−1)th carry signal CRSk−1. During the k-th horizontal period HPk, the electric potential of the first node NQ is boosted to a second high voltage VQ2 from the first high voltage VQ1, and the k-th gate signal GSk is output.

The voltage of the first node NQ decreases to the second discharge voltage VSS2 by the operation of the second control transistor TR2-2 during the (k+1)th horizontal period HPk+1 and the periods following the (k+1)th horizontal period HPk+1. During the (k+1)th horizontal period HPk+1, the second control transistor TR2-2 turned on in response to the (k+1)th carry signal CRSk+1 applies the second discharge voltage VSS2 to the first node NQ, and during the periods following the (k+1)th horizontal period HPk+1, the second control transistor TR2-2 turned on in response to the switching signal applies the second discharge voltage VSS2 to the first node NQ.

The voltage of the first node NQ is maintained in the second discharge voltage VSS2 before the k-th gate signal GSk of the next frame period following the (k+1)th horizontal period HPk+1 is output. Accordingly, the first and second output transistors TR1-1 and TR1-2 are maintained in an off state before the k-th gate signal GSk of the next frame period following the (k+1)th horizontal period HPk+1 is output.

Referring to FIGS. 6 and 7, the second control part 300 outputs the switching signal to the second node NA. The second control part 300 includes a first inverter transistor TR3-1 (or a first switching transistor TR3-1) and a second inverter transistor TR3-2 (or a second switching transistor TR3-2). The switching signal may have the phase of the second node NA shown in FIG. 7.

The first inverter transistor TR3-1 includes a first control electrode receiving the clock signal CKV, an input electrode receiving the clock signal CKV, and an output electrode outputting the switching signal to the second node NA. The signal output from the first inverter transistor TR3-1 is synchronized with the clock signal CKV. The signal output from the first inverter transistor TR3-1 has a voltage level increasing to a maximum voltage level during the high period of the clock signal CKV, and the voltage level of the signal output from the first inverter transistor TR3-1 decreases to a minimum voltage level during the low period of the clock signal CKV.

The second inverter transistor TR3-2 includes a first control electrode connected to the carry terminal CR, an input electrode receiving the second discharge voltage VSS2, and an output electrode connected to the second node NA. The second inverter transistor TR3-2 is turned on in response to the k-th gate signal GSk to lower the voltage level of the second node NA to the second discharge voltage VSS2. As shown in FIG. 7, the second node NA has the low level during the k-th horizontal period HPk.

In the present example embodiment, each of the first and second inverter transistors TR3-1 and TR3-2 includes two control electrodes. Each of the first and second inverter transistors TR3-1 and TR3-2 further includes a second control electrode receiving the second discharge voltage VSS2. The second control electrode receives a negative bias voltage, and the voltage level thereof may be changed. This will be described in detail later.

The pull-down part 400 includes a first pull-down part 410 that pulls down the output terminal OUT and a second pull-down part 320 that pulls down the carry terminal CR.

The first pull-down part 410 includes a first pull-down transistor TR4-1 and the second pull-down part 420 includes a second pull-down transistor TR4-2.

The first pull-down transistor TR4-1 includes a first control electrode receiving the second control signal, a second control electrode receiving the switching signal, an input electrode receiving the first discharge voltage VSS1, and an output electrode connected to the output terminal OUT, i.e., the output electrode of the first output transistor TR1-1. The second pull-down transistor TR4-2 includes a first control electrode receiving the second control signal, a second control electrode receiving the switching signal, an input electrode receiving the second discharge voltage VSS2, and an output electrode connected to the carry terminal CR (e.g., the output electrode of the second output transistor TR1-2).

As shown in FIG. 7, the voltage of the k-th gate signal GSk after the (k+1)th horizontal period HPk+1 corresponds to the first discharge voltage VSS1. The first pull-down transistor TR4-1 applies the first discharge voltage VSS1 to the output terminal OUT in response to the (k+1)th carry signal CRSk+1 during the (k+1)th horizontal period HPk+1. During the period after the (k+1)th horizontal period HPk+1, the first pull-down transistor TR4-1 applies the first discharge voltage VSS1 to the output terminal OUT in response to the switching signal.

After the (k+1)th horizontal period HPk+1, the voltage of the k-th carry signal CRSk corresponds to the second discharge voltage VSS2. During the (k+1)th horizontal period HPk+1, the second pull-down transistor TR4-2 applies the second discharge voltage VSS2 to the carry terminal CR in response to the (k+1)th carry signal CRSk+1. During the period after the (k+1) the horizontal period HPk+1, the second pull-down transistor TR4-2 applies the second discharge voltage VSS2 to the carry terminal CR in response to the switching signal.

In the present example embodiment, the first and second pull-down transistors TR4-1 and TR4-2, each including two control electrodes, have been described as representative examples, but they should not be limited thereto or thereby. The second control electrode of each of the first and second pull-down transistors TR4-1 and TR4-2 may be omitted according to embodiments.

As shown in FIG. 6, the stabilization part 500 includes a stabilization transistor TR5. The stabilization transistor TR5 includes a control electrode receiving the first control signal, an input electrode receiving the second discharge voltage VSS2, and an output electrode connected to the second node NA. The stabilization transistor TR5 stabilizes the second node NA to the second discharge voltage VSS2 in response to the (k−1)th carry signal CRSk−1.

The driving stage SRCk including nine transistors TR1-1, TR1-2, TR2-1, TR2-2, TR3-1, TR3-2, TR4-1, TR4-2, and TR5 have been described with reference to FIGS. 6 and 7. Among the nine transistors TR1-1, TR1-2, TR2-1, TR2-2, TR3-1, TR3-2, TR4-1, TR4-2, and TR5, each of six transistors TR2-1, TR2-2, TR3-1, TR3-2, TR4-1, and TR4-2 may include two control electrodes. The six transistors TR2-1, TR2-2, TR3-1, TR3-2, TR4-1, and TR4-2 having similar configurations may be classified into three types according to their objects and effects. Hereinafter, the six transistors TR2-1, TR2-2, TR3-1, TR3-2, TR4-1, and TR4-2 will be described in more detail with reference to FIGS. 8 to 10C.

Figure 8:
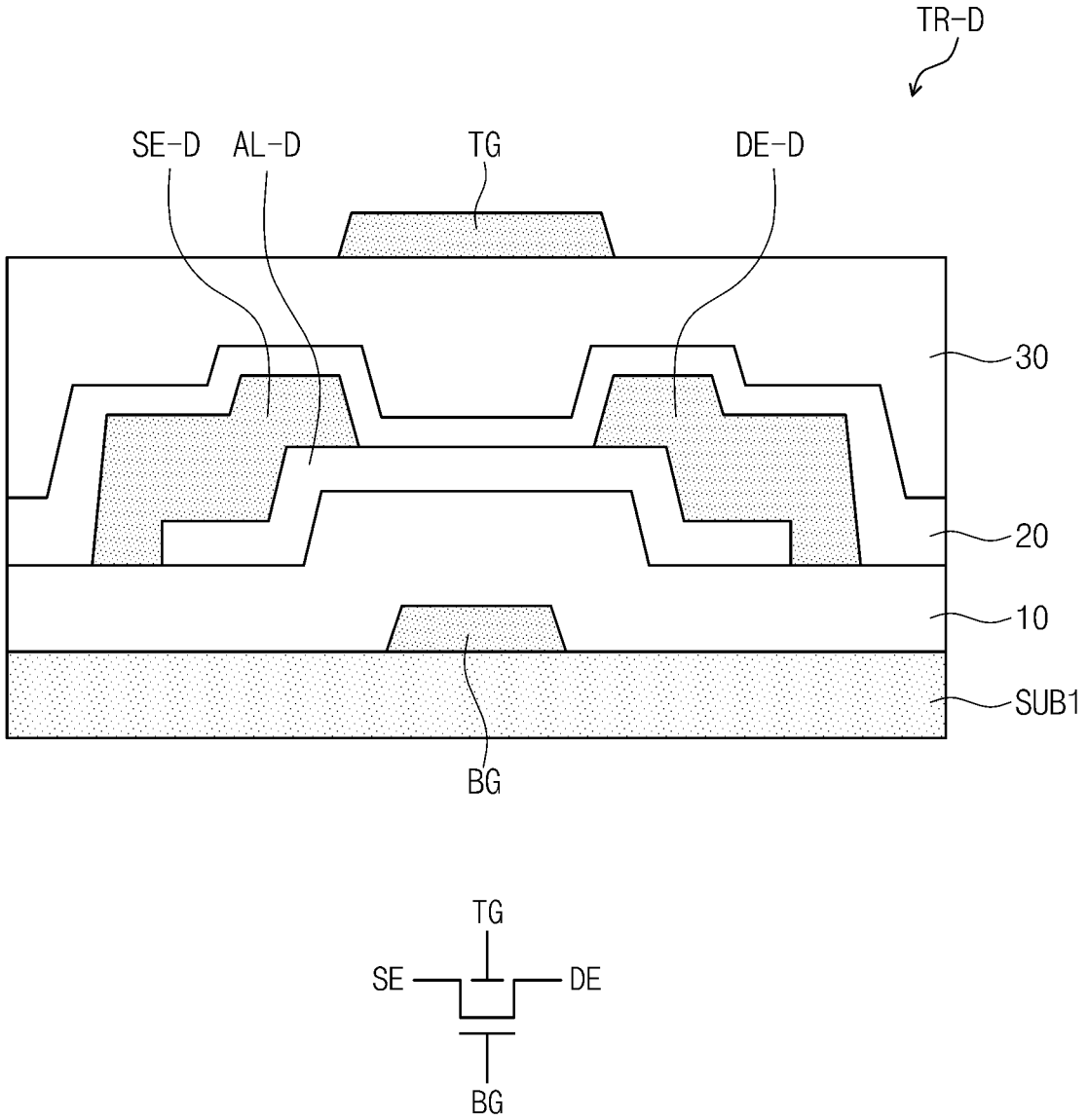
FIG. 8 is a cross-sectional view and a circuit diagram showing a transistor having a double gate structure according to some example embodiments of the present disclosure.
Figure 9A:
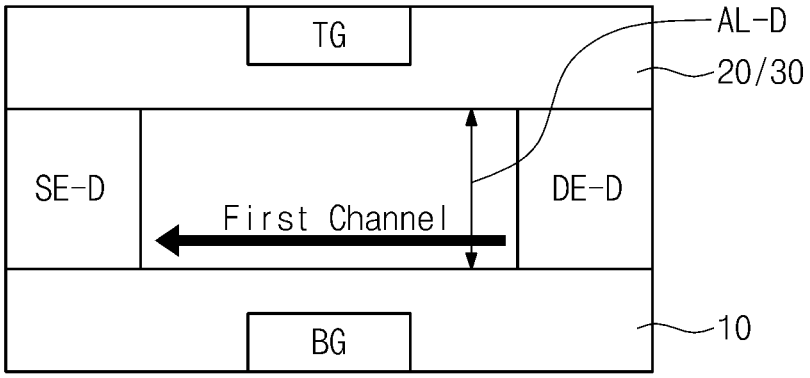
FIGS. 9A and 9B are views showing a channel property varied depending on a second control voltage of the transistor having the double gate structure according to some example embodiments of the present disclosure.
Figure 9B:
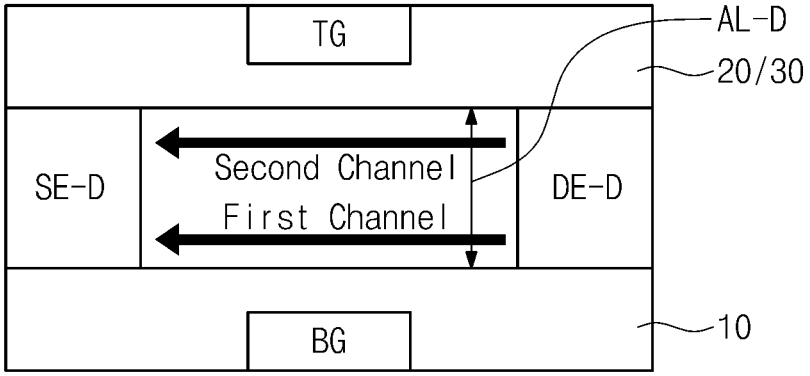
Figure 10A:
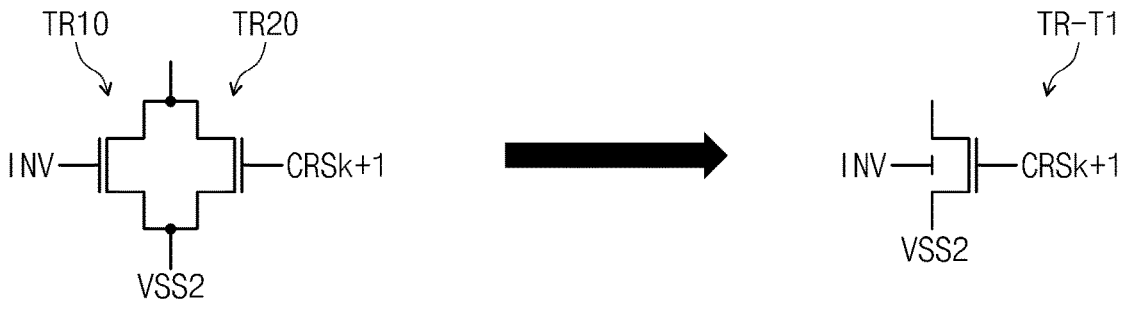
FIGS. 10A to 10C are circuit diagrams showing a transistor having a single gate structure and a transistor having a double gate structure according to some example embodiments of the present disclosure.
Figure 10B:
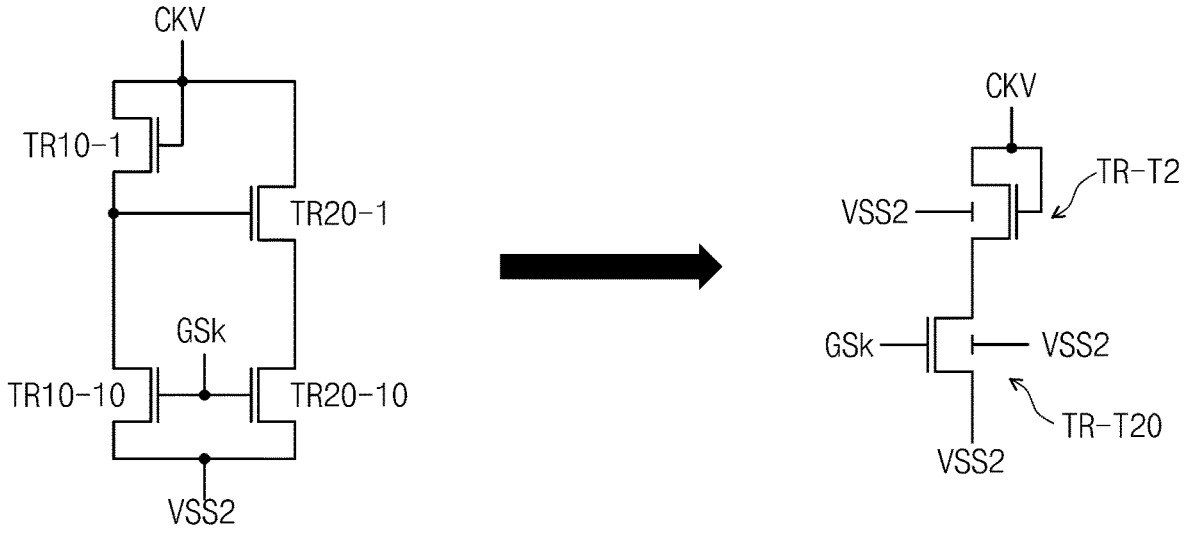
Figure 10C:
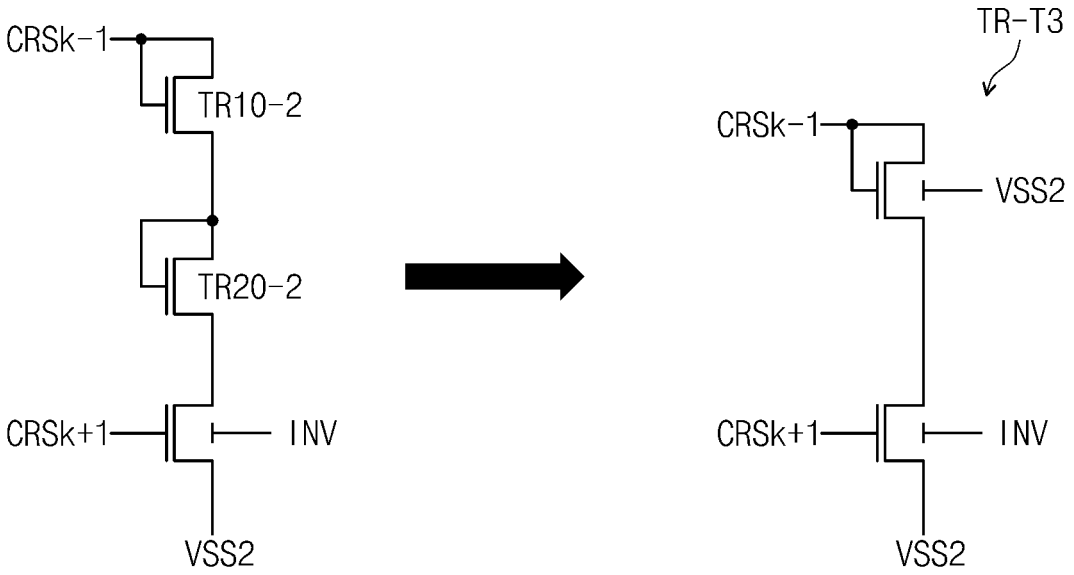

FIG. 8 is a cross-sectional view and a circuit diagram showing a transistor having a double gate structure according to an example embodiment of the present disclosure, FIGS. 9A and 9B are views showing a channel property varied depending on a second control voltage of the transistor having the double gate structure, and FIGS. 10A to 10C are circuit diagrams showing a transistor having a single gate structure and a transistor having a double gate structure.

The six transistors TR2-1, TR2-2, TR3-1, TR3-2, TR4-1, and TR4-2 shown in FIG. 6 may have substantially the same structure as that of the double gate transistor TR-D shown in FIG. 8. The double gate transistor TR-D may be formed through the same process as that of the pixel transistor TR described with reference to FIG. 4.

The double gate transistor TR-D is arranged on a first base substrate SUB1. The double gate transistor TR-D includes a first control electrode BG, an active part AL-D overlapped with the first control electrode BG, an input electrode DE-D, an output electrode SE-D, and a second control electrode TG. The first control electrode BG is formed by the same photolithography process as the control electrode GE of the pixel transistor TR, and includes the same material as the control electrode GE of the pixel transistor TR, and has the same stack structure as the control electrode GE of the pixel transistor TR. The active part AL-D is formed by the same photolithography process as the active part AL of the pixel transistor TR, and includes the same material as the active part AL of the pixel transistor TR, and has the same stack structure as the active part AL of the pixel transistor TR.

The input electrode DE-D and the output electrode SE-D are formed through the same photolithography process as the input electrode DE of the pixel transistor TR, include the same material as the input electrode DE of the pixel transistor TR, and have the same stack structure as the input electrode DE of the pixel transistor TR. The input electrode DE-D and the output electrode SE-D are arranged on the same layer, i.e., the second insulating layer 20, as the input electrode DE of the pixel transistor TR.

In the present example embodiment, the second control electrode TG is arranged on the third insulating layer 30. The second control electrode TG is formed by the same photolithography process as the pixel electrode PE of the pixel transistor TR, and includes the same material as the pixel electrode PE of the pixel transistor TR, and has the same stack structure as the pixel electrode PE of the pixel transistor TR. In the present example embodiment, the second control electrode TG may be arranged on the second insulating layer 20. This is because the third insulating layer 30 may be partially removed to expose a portion of the second insulating layer 20.

Referring to FIGS. 9A and 9B, the double gate transistor TR-D has the channel property varied depending on a control voltage applied to the second control electrode TG. FIG. 9A shows the channel property of the double gate transistor TR-D in which a negative voltage is applied to the second control electrode TG, and FIG. 9B shows the channel property of the double gate transistor TR-D in which a positive voltage is applied to the second control electrode TG As shown in FIG. 9A, when the negative direct current voltage (in case of n-type TFT) is applied to the second control electrode TG during a period (e.g., a predetermined period), the active part AL-D (e.g., a metal oxide semiconductor layer of a metal oxide transistor) has a depletion property. When the active part AL-D has the depletion property, the direct current voltage applied to the second control electrode TG controls a threshold voltage of the double gate transistor TR-D. That is, when the metal oxide semiconductor layer has the depletion property, the second control electrode TG is electrically coupled to the first control electrode BG. In this case, as the direct current voltage applied to the second control electrode TG decreases, the threshold voltage increases. As described above, the double gate transistor TR-D including the second control electrode TG applied with the negative voltage has a single channel in which the threshold voltage is controlled depending on the level of the direct current voltage applied to the second control electrode TG.

In the case that the negative direct current voltage is not applied to the second control electrode TG, the active part AL-D has an accumulation property or an inversion property other than the depletion property. In this case, the second control electrode TG is not electrically coupled to the first control electrode BG. Therefore, the variation in the threshold voltage, which is caused by the level of the direct current voltage applied to the second control electrode TG, does not occur.

As shown in FIG. 9B, when the positive voltage is applied to the second control electrode TG, a dual channel is defined. Thus, the double gate transistor TR-D may be turned on by the signal applied to the first control signal BG and turned on by the signal applied to the second control electrode TG.

Among the transistors TR2-1, TR2-2, TR3-1, TR3-2, TR4-1, and TR4-2 having the double gate structure shown in FIG. 6, the transistors TR2-1, TR3-1, and TR3-2 have the property described with reference to FIG. 9A. Among the transistors TR2-1, TR2-2, TR3-1, TR3-2, TR4-1, and TR4-2 having the double gate structure shown in FIG. 6, the transistors TR2-2, TR4-1, and TR4-2 have the property described with reference to FIG. 9B.

A first type transistor TR-T1 shown in FIG. 10A represents some transistors TR2-2, TR4-1, and TR4-2 among the transistors tR2-1, TR2-2, TR3-1, TR3-2, TR4-1, and tR4-2 having the double gate structure. The first type transistor TR-T1 replaces two transistors TR10 and TR20 connected to each other in parallel. The first type transistor TR-T1 is turned on by a first control signal CRSk+1 applied to the first control electrode and turned on by a second control signal INV applied to the second control electrode. As described with reference to FIG. 6, the first control signal CRSk+1 is the (k+1)th carry signal, and the second control signal INV is the switching signal.

Second type transistors TR-T2 and TR-T20 shown in FIG. 10B represent some transistors TR3-1 and TR3-2 among the transistors TR2-1, TR2-2, TR3-2, TR4-1, and TR4-2 having the double gate structure. Among the second type transistors TR-T2 and TR-T20, one transistor TR-T2 replaces two transistors TR10-1 and TR20-1 interconnected to each other, and the other transistor TR-T20 replaces two transistors TR10-10 and TR20-10.

A third type transistor TR-T3 shown in FIG. 10C represents the transistor TR2-1 among the transistors TR2-1, TR2-2, TR3-1, TR3-2, TR4-1, and TR4-2 having the double gate structure. The third type transistor TR-T3 replaces two transistors TR10-2 and TR20-2 connected to each other in series.

When the three-type transistors TR-T1, TR-T2, and TR-T3 described with reference to FIGS. 10A to 10C are applied to the driving stage SRCk, the circuit configuration of the driving stage may be simplified. Because the circuit configuration of the driving stage may be simplified, an area required for the gate driving circuit may be reduced, and thus a bezel area of the display device may be reduced. FIG. 6 shows the driving stage SRCk including all three types of the transistors, but at least one type of the transistors may be replaced with the single gate transistor.

Figure 11:
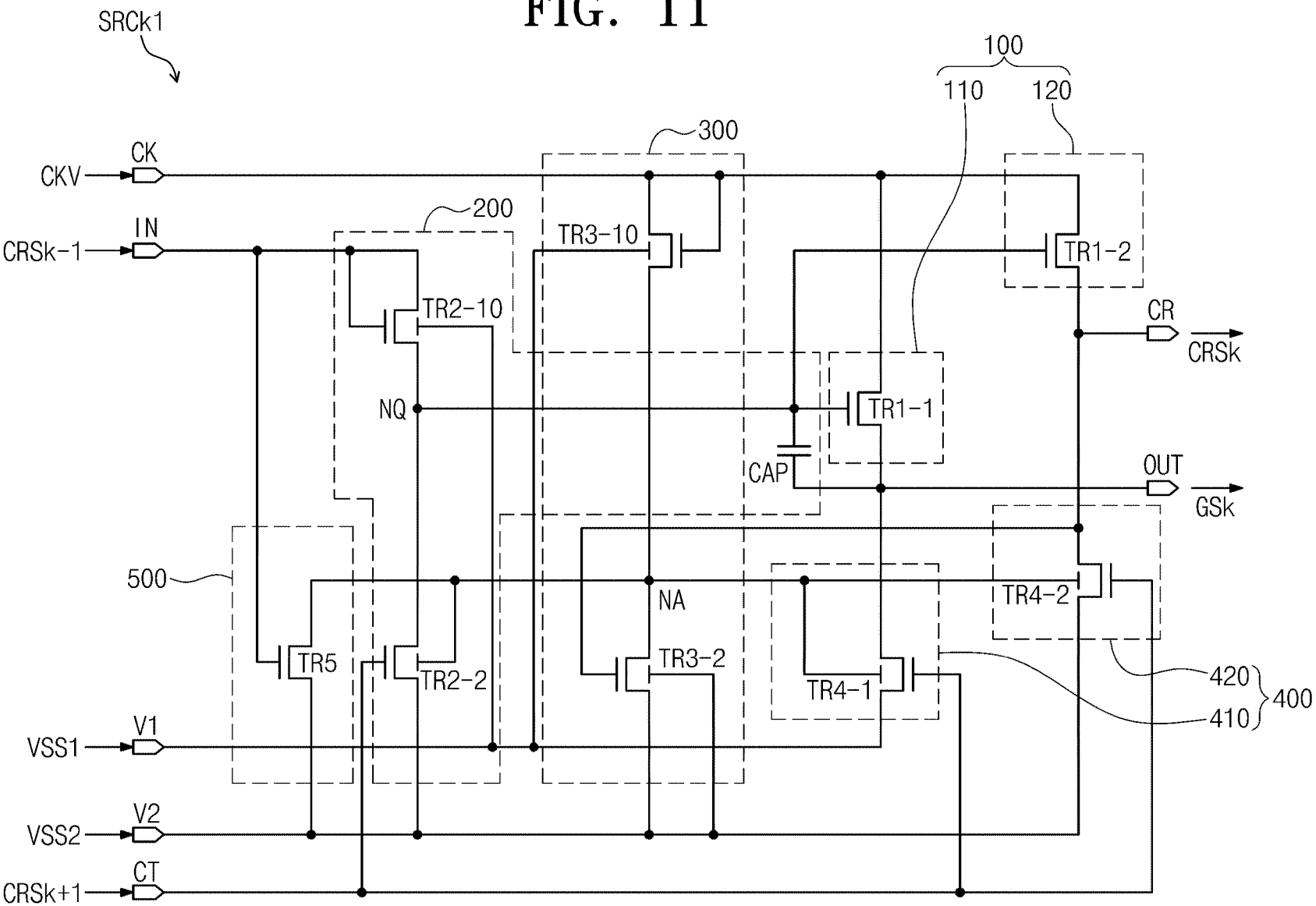
FIG. 11 is a circuit diagram showing a driving stage according to some example embodiments of the present disclosure.
Figure 12:
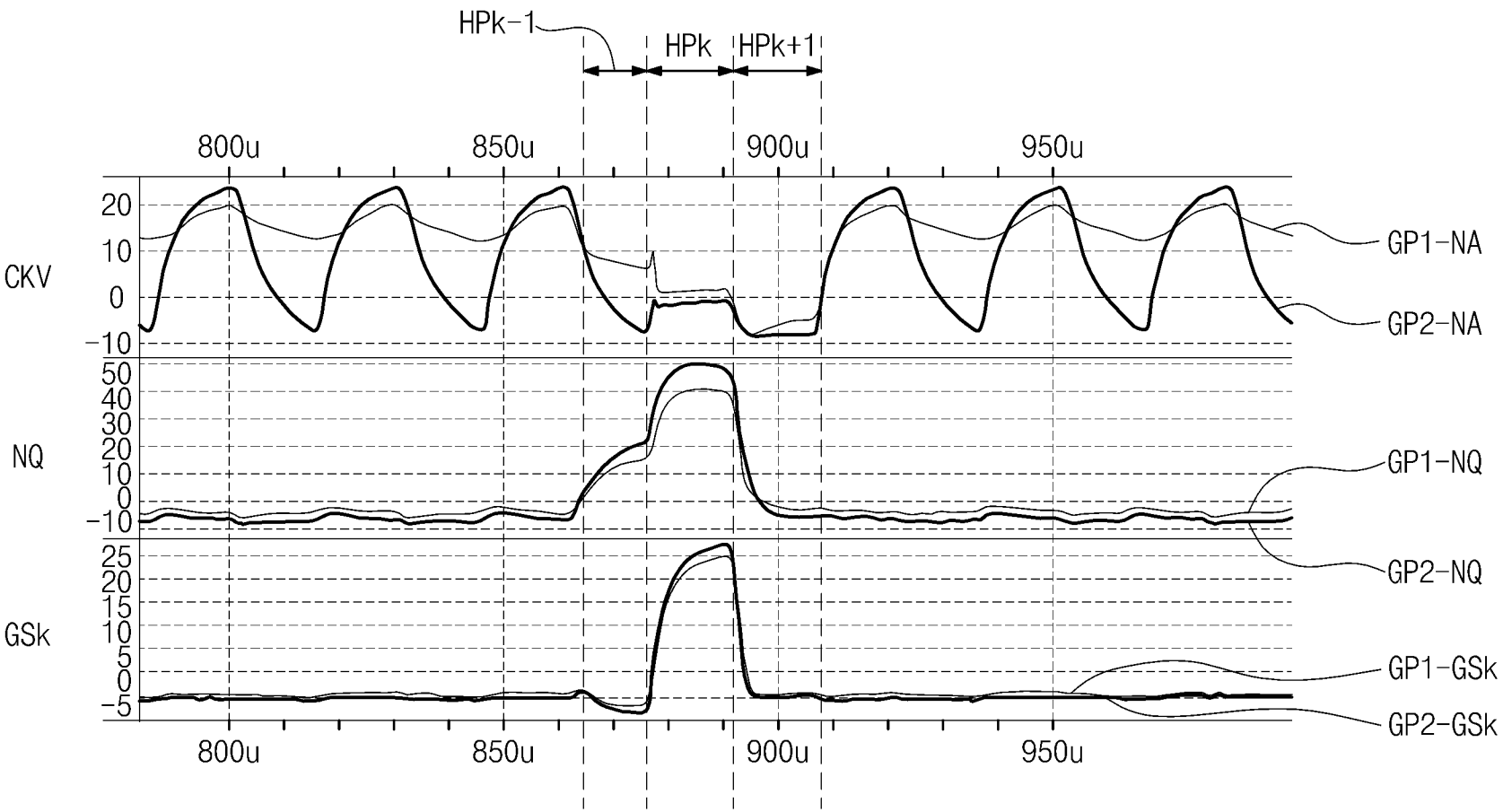
FIG. 12 is a waveform diagram showing a signal of the driving stage shown in FIG. 11.

FIG. 11 is a circuit diagram showing a driving stage SRCk1 according to an example embodiment of the present disclosure, and FIG. 12 is a waveform diagram showing a signal of the driving stage SRCk1 shown in FIG. 11. Hereinafter, the driving stage SRCk1 according to the present example embodiment will be described with reference to FIGS. 11 and 12. In the present example embodiment, some repetitive descriptions of the same or similar elements as those described with reference to FIGS. 1 to 10C may be omitted.

Referring to FIG. 11, a second control electrode of each of a first control transistor TR2-10 and a first inverter transistor TR3-10 receives the first discharge voltage VSS1 higher than the second discharge voltage VSS2. A voltage-current characteristic of the first control transistor TR2-10 and the first inverter transistor TR3-10 shown in FIG. 11 is negatively shifted from the voltage-current characteristic of the first control transistor TR2-1 and the first inverter transistor TR3-1 shown in FIG. 6.

In FIG. 12, a first graph GP1-NA shows a variation in phase of the second node NA shown in FIG. 7, and a second graph GP2-NA shows a variation in phase of the second node NA shown in FIG. 11. Because the voltage-current characteristic of the first inverter transistor TR3-10 is negatively shifted, a driving current of the first inverter transistor TR3-10 increases. Accordingly, a high level of the switching signal output from the first inverter transistor TR3-10 further increases, a low level of the switching signal output from the first inverter transistor TR3-10 further decreases.

In FIG. 12, a third graph GP1-NQ shows a variation in phase of the first node NQ shown in FIG. 7, and a fourth graph GP2-NQ shows a variation in phase of the first node NQ shown in FIG. 11. A fifth graph GP1-GSk shows the gate signal shown in FIG. 7, and a sixth graph GP2-GSk shows the gate signal shown in FIG. 11. Because the driving current of the first control transistor TR2-10 increases, the voltage level of the first node NQ further increases during the k-th horizontal period HPk. Therefore, the output of the k-th gate signal GSk is not delayed, and the high level of the k-th gate signal GSk further increases.

The first discharge voltage VSS1 may be applied to the second control electrode of the second inverter transistor TR3-2.

Figure 13:
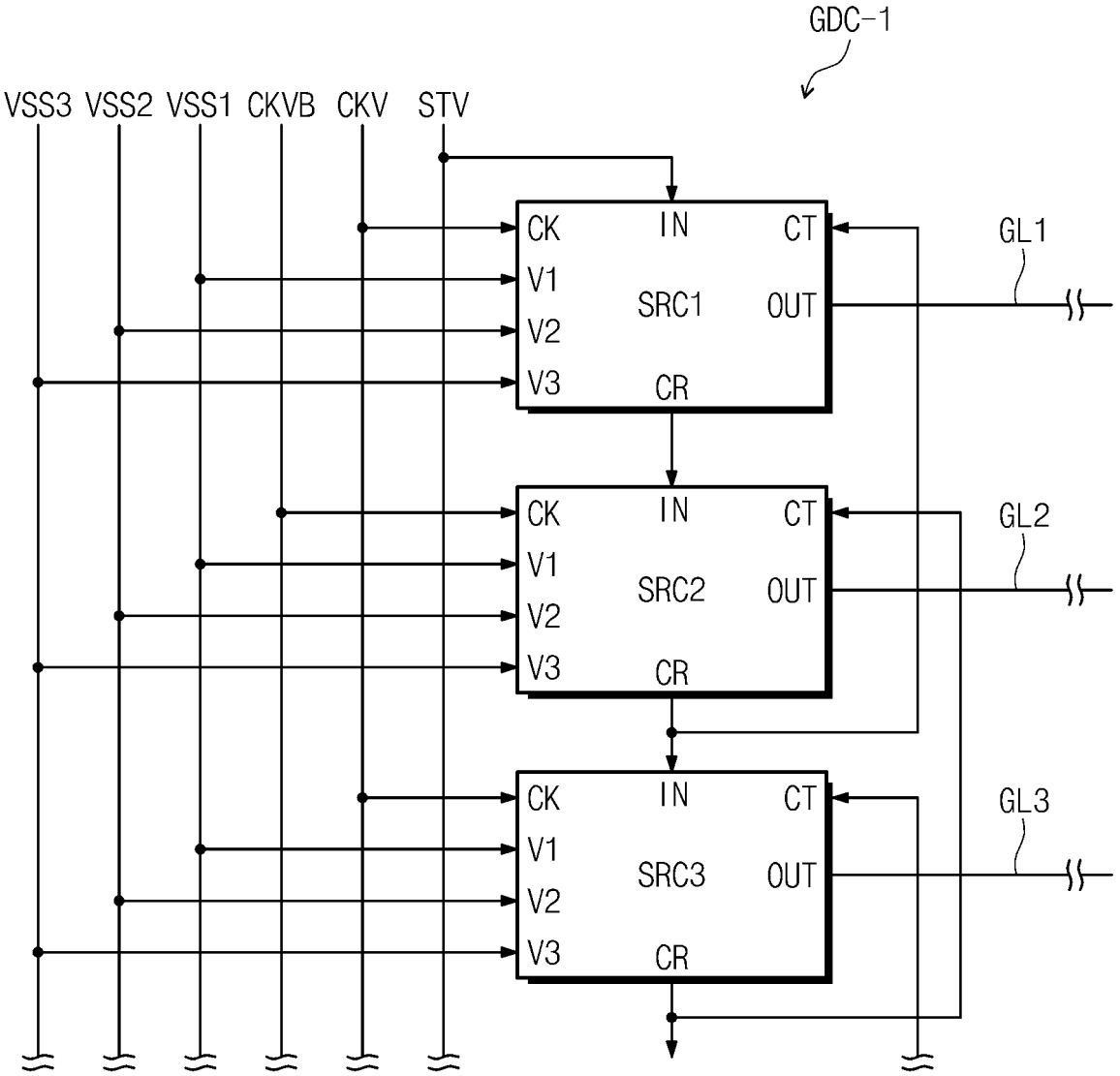
FIG. 13 is a block diagram showing a gate driving circuit according to some example embodiments of the present disclosure.
Figure 14:
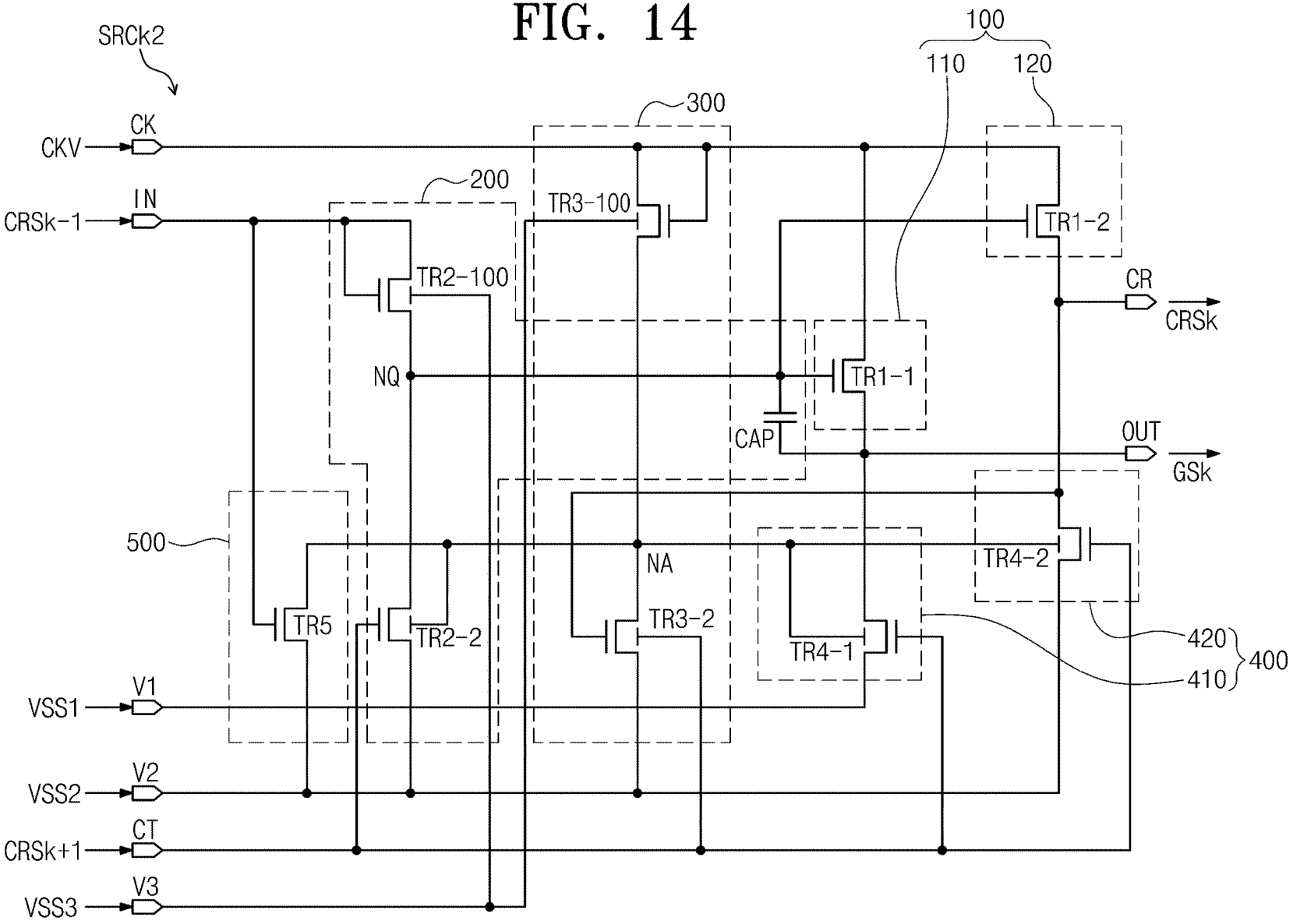
FIG. 14 is a circuit diagram showing a driving stage according to some example embodiments of the present disclosure.

FIG. 13 is a block diagram showing a gate driving circuit GDC-1 according to an example embodiment of the present disclosure, and FIG. 14 is a circuit diagram showing a driving stage SRCk2 according to an example embodiment of the present disclosure. Hereinafter, the driving stage SRCk2 according to the present example embodiment will be described with reference to FIGS. 13 and 14. In the present example embodiment, some repetitive descriptions of the same or similar elements as those described with reference to FIGS. 1 to 12 may be omitted. FIG. 13 shows three stages SRC1, SRC2, and SRC3 among the driving stages, and FIG. 14 shows the circuit diagram of the k-th driving stage SRCk2.

Referring to FIGS. 13 and 14, the driving stage SRCk2 may further include a third voltage input terminal V3. The third voltage input terminal V3 receives a third discharge voltage VSS3. The third discharge voltage VSS3 may be a negative bias voltage having a level different from those of the first and second discharge voltages VSS1 and VSS2.

The third discharge voltage VSS3 may be applied to a second control electrode of each of a first control transistor TR2-100 and a first inverter transistor TR3-100. A voltage-current characteristic of each of the first control transistor TR2-100 and the first inverter transistor TR3-100 according to the level of the third discharge voltage VSS3.

The third discharge voltage VSS3 may be applied to the second control electrode of the second inverter transistor TR3-2 in the present example embodiment.

Figure 15:
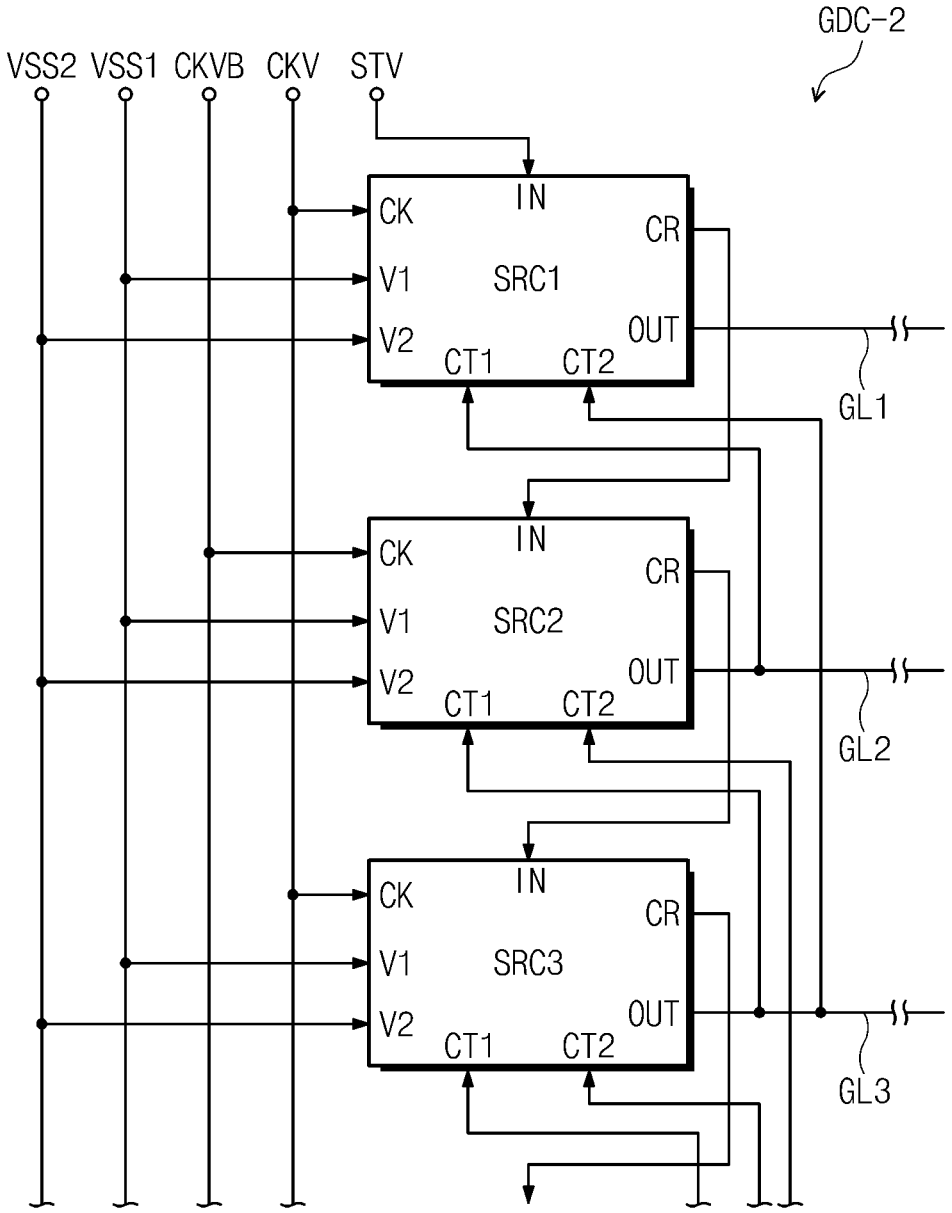
FIG. 15 is a block diagram showing a gate driving circuit according to some example embodiments of the present disclosure.
Figure 16:
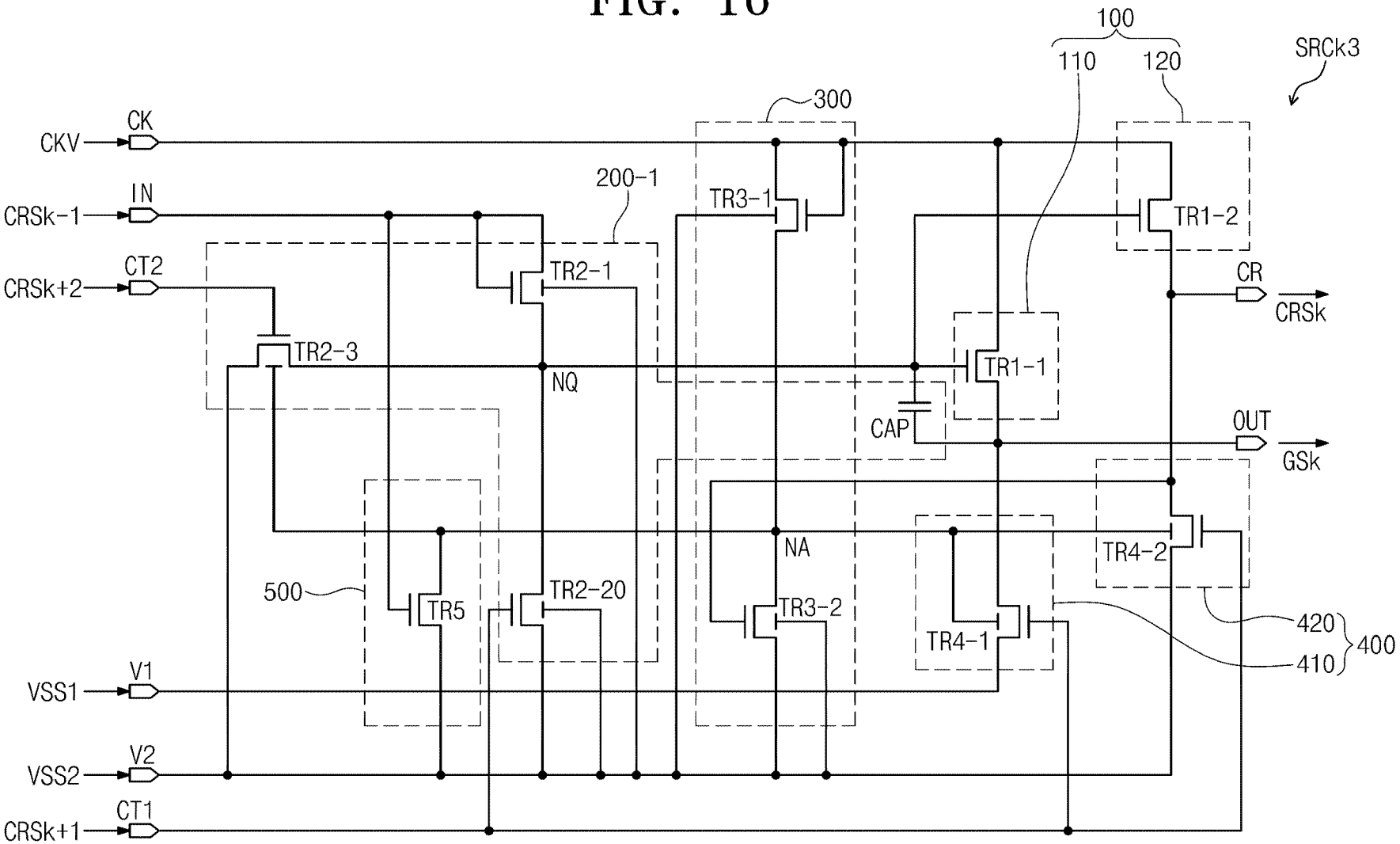
FIG. 16 is a circuit diagram showing a driving stage according to some example embodiments of the present disclosure.

FIG. 15 is a block diagram showing a gate driving circuit GDC-2 according to an example embodiment of the present disclosure, and FIG. 16 is a block diagram showing a driving stage SRCk3 according to an example embodiment of the present disclosure. Hereinafter, the driving stage SRCk3 according to the present example embodiment will be described with reference to FIGS. 15 and 16. In the present example embodiment, detailed descriptions of the same elements as those described with reference to FIGS. 1 to 14 will be omitted. FIG. 15 shows three stages SRC1, SRC2, and SRC3 among the driving stages, and FIG. 16 shows the circuit diagram of the k-th driving stage SRCk3.

Referring to FIGS. 15 and 16, the k-th driving stage SRCk3 includes a first control terminal CT1 and a second control terminal CT2. The first control terminal CT1 corresponds to the control terminal CT shown in FIG. 6. The second control terminal CT2 of the k-th driving stage SRCk3 is electrically connected to the carry terminal CR of the (k+2)th driving stage.

A first control part 200-1 of the k-th driving stage SRCk3 further includes a third control transistor TR2-3. The third control transistor TR2-3 includes a first control electrode receiving a third control signal, a second control electrode receiving a switching signal, an input electrode receiving a second discharge voltage VSS2, and an output electrode connected to the first node NQ. In the present example embodiment, the third control signal may be, but not limited to, a (k+2)th carry signal CRSk+2 output from the (k+2)th driving stage.

In the present example embodiment, the third control transistor TR2-3 includes two control electrodes. In the present example embodiment, the second control electrode of the third control transistor TR2-3 may be omitted, and the input electrode may receive the first discharge voltage VSS1.

The third control transistor TR2-3 applies the second discharge voltage VSS2 to the first node NQ in response to the third control signal. The third control transistor TR2-3 applies the second discharge voltage VSS2 to the first node NQ in response to the switching signal. The third control transistor TR2-3 may have the dual channel as described with reference to FIG. 9B and may be the first type of transistor TR-T1 as described with reference to FIG. 10A.

The second control transistor TR2-20 according to the present example embodiment is substantially the same as the second control transistor TR2-2 shown in FIG. 6 except that the second control electrode of the second control transistor TR2-20 receives a signal different from that of the second control electrode of the second control transistor TR2-2. The second control electrode of the second control transistor TR2-20 receives a negative bias voltage, e.g., the second discharge voltage VSS2. The second control transistor TR2-20 may be a transistor TR-T30 similar to the third type of transistor TR-T3 described with reference to FIG. 10C.

Figure 17:
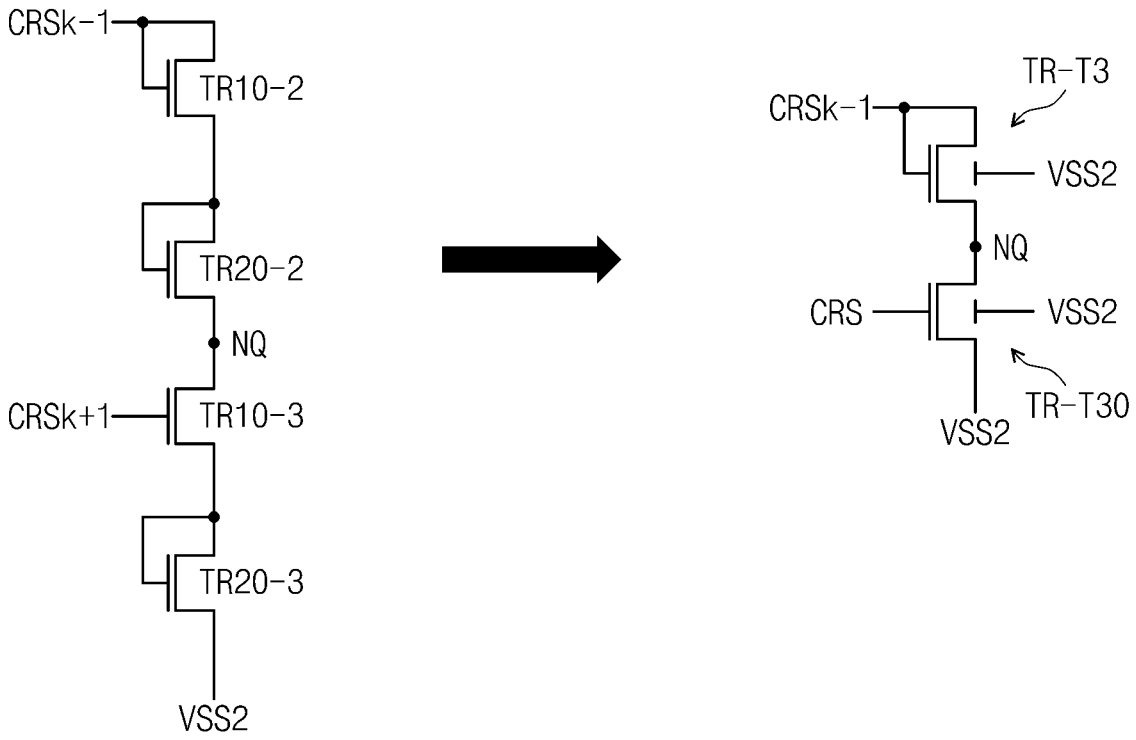
FIG. 17 is a circuit diagram showing a transistor having a single gate structure and a transistor having a double gate structure according to some example embodiments of the present disclosure.

In the present example embodiment, each of the first control transistor TR2-1 and the second control transistor TR2-20 may replaces two transistors connected to each other in series as the third type of transistors TR-T3 and TR-T30 shown in FIG. 17.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

Although the example embodiments of the present invention have been described, it is understood that the present invention should not be limited to these example embodiments but various changes and modifications can be made by one ordinary skilled in the art within the spirit and scope of the present invention as defined by the appended claims, and their equivalents.

What is claimed is:

1. A display device comprising: a display panel comprising a plurality of gate lines; and a gate driving circuit comprising a plurality of driving stages configured to apply gate signals to the gate lines, a k-th (k is a natural number equal to or greater than 2) driving stage from among the driving stages comprising: a first output transistor comprising a control electrode connected to a first node, an input electrode configured to receive a clock signal and an output electrode configured to output a k-th gate signal from among the gate signals; a capacitor connected between the output electrode of the first output transistor and the control electrode of the first output transistor; a first control transistor configured to output a first control signal to the first node before the k-th gate signal is output; a first inverter transistor configured to output a switching signal to a second node; and a first pull-down transistor comprising a first active part, a first control electrode configured to receive a second control signal activated after the k-th gate signal is output, a second control electrode connected to the second node, an input electrode configured to receive a first discharge voltage, and an output electrode connected to the output electrode of the first output transistor, wherein the first active part is between the first control electrode and the second control electrode in a cross-sectional view of the first pull-down transistor.

2. The display device of claim 1, wherein the k-th driving stage further comprises a second output transistor comprising a control electrode connected to the first node, an input electrode configured to receive the clock signal and an output electrode configured to output a k-th carry signal.

3. The display device of claim 2, wherein the k-th driving stage further comprises a second pull-down transistor configured to output a second discharge voltage having a level different from a level of the first discharge voltage.

4. The display device of claim 3, wherein the second pull-down transistor comprises a second active part, a first control electrode configured to receive the second control signal, a second control electrode configured to receive the switching signal, an input electrode configured to receive the second discharge voltage and an output electrode connected to the output electrode of the second output transistor, and wherein the second active part of the second pull-down transistor is between the first control electrode of the second pull-down transistor and the second control electrode of the second pull-down transistor in a cross-sectional view of the second pull-down transistor.

5. The display device of claim 1, wherein the k-th driving stage further comprises a second control transistor configured to output a second discharge voltage having a level different from a level of the first discharge voltage to the first node.

6. The display device of claim 5, wherein the second control transistor comprises a second control transistor active part, a first control electrode configured to receive the second control signal, a second control electrode configured to receive the switching signal, and an input electrode configured to receive the second discharge voltage, and an output electrode connected to the first node, wherein the second control transistor active part is between the first control electrode of the second control transistor and the second control electrode of the second control transistor in a cross-sectional view of the second control transistor.

7. The display device of claim 5, wherein the second control signal is output from a (k+1)th driving stage from among the driving stages, and the second control signal is synchronized with a (k+1)th gate signal from among the gate signals.

8. The display device of claim 5, wherein the first control transistor comprises a first control transistor active part, a first control electrode configured to receive the first control signal, an input electrode configured to receive the first control signal, and an output electrode connected to the first node.

9. The display device of claim 8, wherein the first control signal is output from a (k−1)th driving stage from among the driving stages and the first control signal is synchronized with a (k−1)th gate signal from among the gate signals.

10. The display device of claim 8, wherein the first control transistor further comprises a second control electrode configured to receive a negative bias voltage, and wherein the first control transistor active part of the first control transistor is between the first control electrode of the first control transistor and the second control electrode of the first control transistor in a cross-sectional view of the first control transistor.

11. The display device of claim 10, wherein the negative bias voltage is the second discharge voltage.

12. The display device of claim 8, wherein the k-th driving stage further comprises a stabilization transistor comprising a control electrode configured to receive the first control signal, an input electrode configured to receive the second discharge voltage, and an output electrode connected to the second node.

13. The display device of claim 5, wherein the k-th driving stage further comprises a third control transistor configured to output the second discharge voltage to the first node.

14. The display device of claim 13, wherein the third control transistor comprises a third control transistor active part, a first control electrode configured to receive a third control signal, a second control electrode configured to receive the switching signal, an input electrode configured to receive the second discharge voltage and an output electrode connected to the first node.

15. The display device of claim 14, wherein the third control signal is output from a (k+2)th driving stage from among the driving stages and the third control signal is synchronized with a (k+1)th gate signal from among the gate signals.

16. The display device of claim 5, wherein the second control transistor comprises a second control transistor active part, a first control electrode configured to receive the second control signal, a second control electrode configured to receive a negative bias voltage, an input electrode configured to receive the second discharge voltage, and an output electrode connected to the first node, and wherein the second control transistor active part, of the second control transistor is between the first control electrode of the second control transistor and the second control electrode of the second control transistor in a cross-sectional view of the second control transistor.

17. The display device of claim 1, wherein the k-th driving stage further comprises a second inverter transistor configured to output a second discharge voltage having a level different from a level of the first discharge voltage to the second node.

18. The display device of claim 17, wherein the second inverter transistor comprises a second inverter transistor active part, a first control electrode configured to receive a k-th carry signal, an input electrode configured to receive the second discharge voltage, and an output electrode connected to the second node.

19. The display device of claim 18, wherein at least one transistor of the first inverter transistor and the second inverter transistor further comprises a second control electrode configured to receive a negative bias voltage.

20. A display device comprising: a display panel comprising a plurality of gate lines; and a gate driving circuit comprising a plurality of driving stages electrically connected to the gate lines, respectively, a k-th (k is a natural number equal to or greater than 2) driving stage from among the driving stages comprising: an output circuit configured to output a k-th gate signal and a k-th carry signal in response to a voltage of a first node, the k-th gate signal and the k-th carry signal being generated according to a dock signal; a first control circuit configured to control the voltage of the first node; a second control circuit configured to apply a switching signal generated according to the dock signal to a second node; and a pull-down circuit configured to lower a voltage of the output circuit after the k-th gate signal and the k-th carry signal are output, wherein the pull-down circuit comprises at least one pull-down transistor, each of the at least one pull-down transistor comprising an active part, a first control electrode configured to receive a first control signal activated after the k-th gate signal is output, a second control electrode configured to receive the switching signal, an input electrode configured to receive one of first and second discharge voltages having different levels and an output electrode connected to the output circuit, wherein the active part is between the first control electrode and the second control electrode in a cross-sectional view of the at least one pull-down transistor.

* * * * *